US007090520B2

(12) United States Patent
Matsukawa et al.

(10) Patent No.: US 7,090,520 B2
(45) Date of Patent: Aug. 15, 2006

(54) VEHICLE MOUNTED ELECTRICAL OUTLET BOX

(75) Inventors: Kazushi Matsukawa, Ichishi-gun (JP); Masaru Yoshida, Taki-gun (JP); Masuo Kitamura, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/912,037

(22) Filed: Aug. 6, 2004

(65) Prior Publication Data

US 2005/0037663 A1 Feb. 17, 2005

(30) Foreign Application Priority Data

Aug. 8, 2003 (JP) ..... 2003-290717

(51) Int. Cl.
*H01R 29/00* (2006.01)

(52) U.S. Cl. ..... 439/188; 200/51.09

(58) Field of Classification Search ..... 439/188; 200/51.09, 51.12

See application file for complete search history.

(56) References Cited

U.S. PATENT DOCUMENTS 4,028,693 A * 6/1977 Kuntz ..... 340/323 R
4,230,386 A * 10/1980 Farnworth et al. ..... 439/188
4,591,732 A * 5/1986 Neuenschwander ..... 439/188
5,071,360 A * 12/1991 Lindow et al. ..... 439/188
5,113,045 A * 5/1992 Crofton ..... 439/188
5,277,602 A * 1/1994 Yi ..... 439/138
5,347,095 A * 9/1994 Zeder ..... 200/51.09
6,495,775 B1 12/2002 Lawson et al. ..... 200/50.28
6,884,111 B1 * 4/2005 Gorman ..... 439/535

FOREIGN PATENT DOCUMENTS

JP 2000-301991 10/2000

* cited by examiner

*Primary Examiner*—Briggitte R. Hammond
(74) *Attorney, Agent, or Firm*—Greenblum & Bernstein, P.L.C.

(57) ABSTRACT

A compact vehicle-mounted electrical outlet box offering a reliable plug blade detection function. The electrical outlet box is formed from synthetic resin rectangular case 1 which includes body 2 and cover 3. A pair of electrical plug blades 100 and 101 are inserted into plug blade insertion slots 5 located on the front surface of case 1 through which the plug blades contact two blade receiver parts 10. The forceful contact of plug blades 100 and 101 rotate two pivot levers 12 which convert the insertion force of plug blades 100 and 101 to a directional force. Two return springs 13 apply pressure to pivot levers 12 in a direction opposite to that applied by the insertion of plug blades 100 and 101. Printed circuit block 14, which is comprised of circuit base plate 14*a* to which each microswitch 14*b* is installed, is housed within case 1. The two pivot levers 12 are located at the approximate mid-point of body 2 between the two mutually facing blade receiver parts.

7 Claims, 32 Drawing Sheets

VEHICLE MOUNTED ELECTRICAL OUTLET BOX

BACKGROUND OF THE INVENTION

1. Field of the Invention

The invention relates to a vehicle mounted electrical outlet box incorporating a switch that detects the presence of plugged in terminal blades.

2. Description of the Background Information

Automotive vehicles have recently being equipped with onboard electrical outlet boxes that allow the use of electrical appliances in the vehicle. These vehicle mounted electrical outlet boxes are able to detect the presence of plug in terminal blades that have been inserted to the outlet. Japanese Kokai (laid open) Patent No. 2000-301991, and particularly paragraphs 0016–0022,0030 and 0031; and FIGS. 1–5, show a conventional automotive electrical outlet box.

Conventional vehicle-mounted electrical outlet boxes of the type noted above require that a plug blade detecting switch be mounted external to the outlet box, thus increasing the size of the outlet box and detracting from its external appearance. Further, the detecting switch does not operate with complete reliability as it may activate the blade detection switch to an "on" state even though the blades may not have been inserted into the outlet. Also, the detecting switch may operate erroneously as a result of vibration or the plug being inserted at an inclined orientation.

SUMMARY OF THE INVENTION

Taking at least the above-noted shortcomings into consideration, the present invention provides a more compact vehicle mounted electrical outlet box that incorporates a reliable plug blade detecting device.

An aspect of the present invention provides a vehicle mounted electrical outlet box including a case including a pair of plug blade insertion slots configured to receive a pair of plug blades inserted therein; a pair of blade receiver portions electrically connected to an electrical power source of the vehicle, the blade receiver portions configured to contact plug blades inserted into the case through the plug blade insertion slots; a pair of plug blade detection mechanisms configured to detect the presence of each plug blade inserted into each the plug blade insertion slot; and a pair of sensor switches, each the sensor switch including 'on' and 'off' switching contact points that operate in response to detection of the presence of a plug blade by the detection mechanism; wherein the detection mechanisms are located between opposing blade receiver portions, and the contact points of each sensor switch are electrically wired together in a series configuration. IN a further aspect of the present invention, each plug blade insertion detection mechanism includes a pivot lever configured to pivot from the insertion of the plug blades into the plug blade insertion slots, each the pivot lever including a pivot shaft pivotably supported by the case, an inclined blade sensor surface through which plug blade insertion force is converted to a directional force that intersects the plug blade insertion direction, and a switch operating part driven by the directional force in order to operate the sensor switches when the pivot lever pivots, wherein the axial ends of aid pivot shaft are formed in an approximately oval shape. In a further aspect of the present invention, each plug blade insertion detection mechanism includes a pivot lever configured to pivot from the force with which the plug blades are inserted into the plug blade insertion slots, each pivot lever including a pivot shaft pivotably supported by the case, an inclined blade sensor surface through which the plug blade insertion force is converted to a directional force that intersects the plug blade insertion direction, and a switch operating part driven by the directional force in order to operate the sensor switches when the pivot lever pivots, wherein the blade receiver part includes a stop flange that presses against the pivot shaft of the pivot lever in order to maintain the pivot lever in a fixed position.

Further, each plug blade insertion detection mechanism may include a pivot lever configured to pivot from the force with which the plug blades are inserted into the plug blade insertion slots, each pivot lever including a pivot shaft pivotably supported by aid case, an inclined blade sensor surface through which the plug blade insertion force is converted to a directional force that intersects the plug blade insertion direction, and a switch operating part driven by the directional force in order to operate the sensor switches when the pivot lever pivots, wherein a return spring applies pressure against the pivot lever in a direction opposite to that in which the pivot lever is pivotably moved by the plug blade insertion force. Further, each plug blade insertion detection mechanism may include a pivot lever configured to pivot from the force with which the plug blades are inserted into the plug blade insertion slots, each pivot lever including a pivot shaft pivotably supported by the case, and an inclined blade sensor surface that changes the plug blade insertion force to a directional force that intersects the plug blade insertion direction, and a switch operating part which is driven by the directional force in order to operate the sensor switches when the pivot lever pivots, wherein a pivot recess is formed within an internal wall in the case in order to pivotably support the pivot shaft, and a metal plate is provided to cover and conceal the pivot recess in order to provide a surface on which the surface of the pivot lever, on which the pivot shaft is formed, may slide. The metal plate thus provides an unhindered sliding surface that prevents the pivot lever from hanging up on the edge of the pivot recess.

In a further aspect of the present invention, each plug blade insertion detection mechanism may include a pivot lever configured to pivot from the force with which the plug blades are inserted into the plug blade insertion slots, each pivot lever including a pivot shaft pivotably supported by the case, an inclined blade sensor surface that changes the plug blade insertion force to a directional force that intersects the plug blade insertion direction, and a switch operating part which is driven by the directional force in order to operate the sensor switches when the pivot lever pivots, wherein a stop notch formed on the pivot lever contacts a surface within the case at a time when the plug blades are not present in the blade insertion slots, the contact occurring in a pivoting direction opposite to that induced by the directional force. Further, the stop notch is formed on both ends of the pivot lever on the radial axis thereof. A structure able to stop the reverse pivoting movement of the pivot lever in order to provide a more stable detection function. In a further aspect of the present invention, each plug blade insertion detection mechanism may include a pivot lever configured to pivot from the force with which the plug blades are inserted into the plug blade insertion slots, each pivot lever including a pivot shaft pivotably supported by the case, an inclined blade sensor surface that changes the plug blade insertion force to a directional force that intersects the plug blade insertion direction, and a switch operating part driven by the directional force in order to operate a sensor switch, which is mounted to a base plate, when the pivot lever pivots from the directional force, wherein the case and base plate are joined through a connection of mutually indexed recessed notches and projecting tabs formed on the case and base plate. Further the vehicle mounted electrical outlet box may include an indicator lamp to indicate when electricity is being supplied. Further, the case is formed of a synthetic resin. Further, the blade receiver portions are made from a flexible electrically conductive material. The blade receiver portions may be configured to press plug blades inserted into the case through the plug blade insertion slots. The blade receiver portions may be configured to forcefully contact plug blade inserted into the case through the plug blade insertion slots.

As noted previously, the vehicle-mounted electrical outlet box invention can be made to more compact dimensions due to the detection mechanisms being located between the two blade receivers which contact the plug blades. Furthermore, the contact points that operate according to the insertion of each plug blade are electrically wired in series so as to activate the detection function only when both plug blades have been inserted. This construction provides a device and method of preventing the insertion of one plug blade, which may result from mischief of other factors, from activating the detection function, and promotes stable operation of the detection function to improve reliability.

BRIEF DESCRIPTION OF THE DRAWINGS

The above, and other objects, features and advantages of the present invention will be made apparent from the following description of the preferred embodiments, given as nonlimiting examples, with reference to the accompanying drawings in which.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

The following will describe embodiments of the invention with reference to the drawings.

Figure 1:
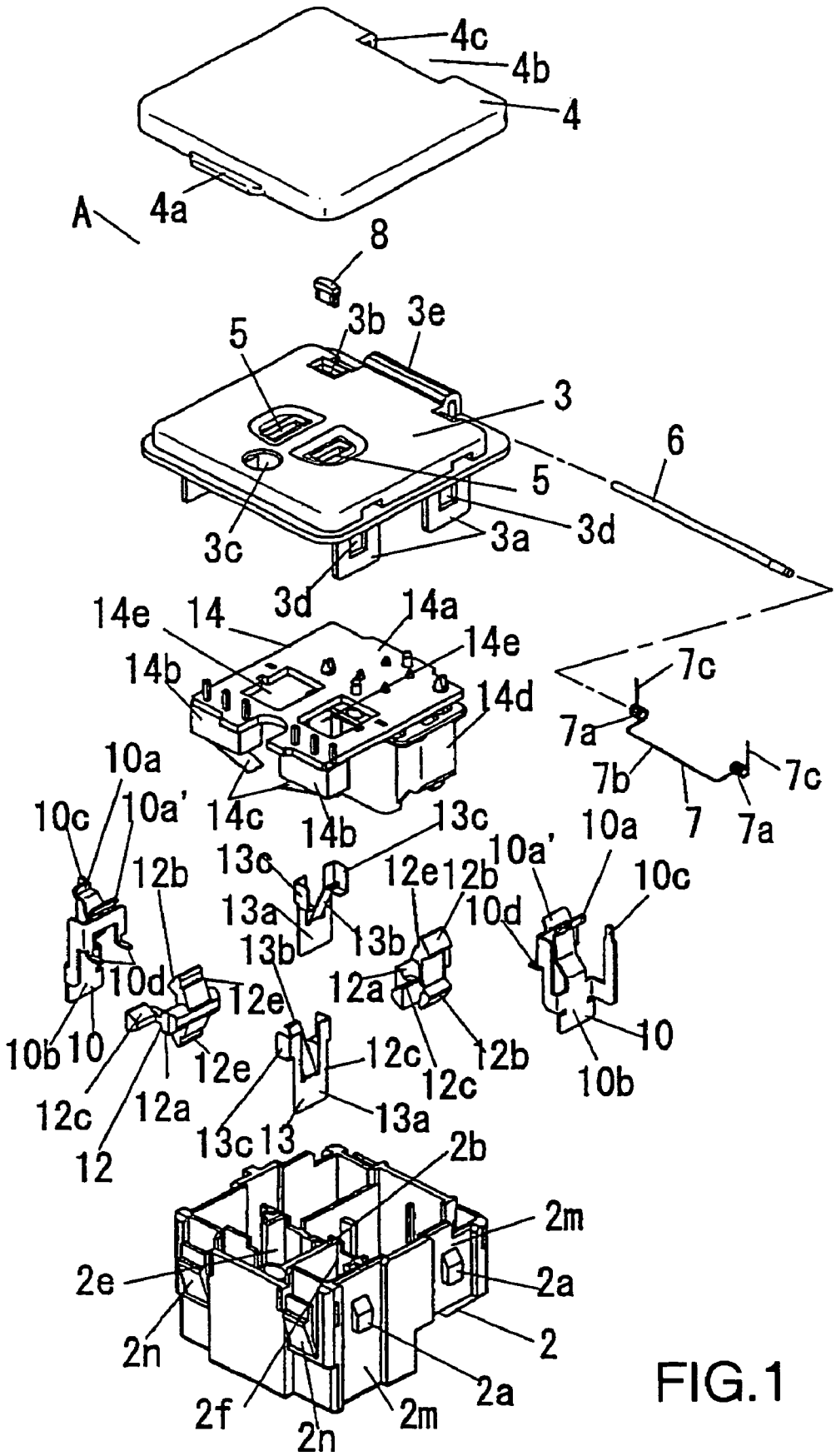
FIG. 1 is an exploded perspective view of the electrical outlet box of the embodiment of the present invention.
Figure 2C:
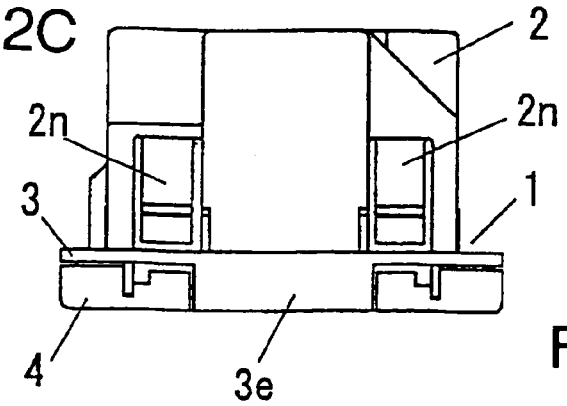
FIG. 2*c* is a plan view of the electrical outlet box of the embodiment of FIG. 1.
Figure 2A:
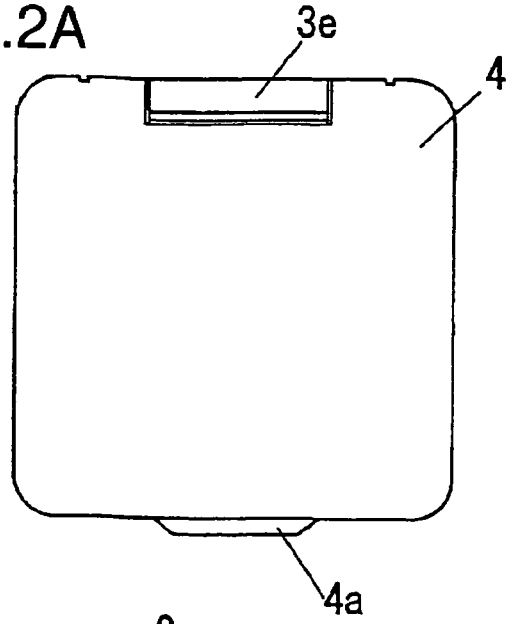
FIG. 2*a* is a front elevational view of the electrical outlet box of the embodiment of FIG. 1.
Figure 2B:
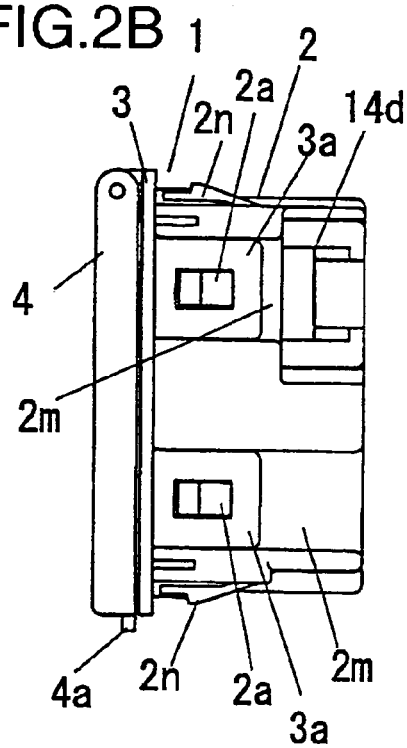
FIG. 2*b* is a side elevational view of the electrical outlet box of the embodiment of FIG. 1.
Figure 2D:
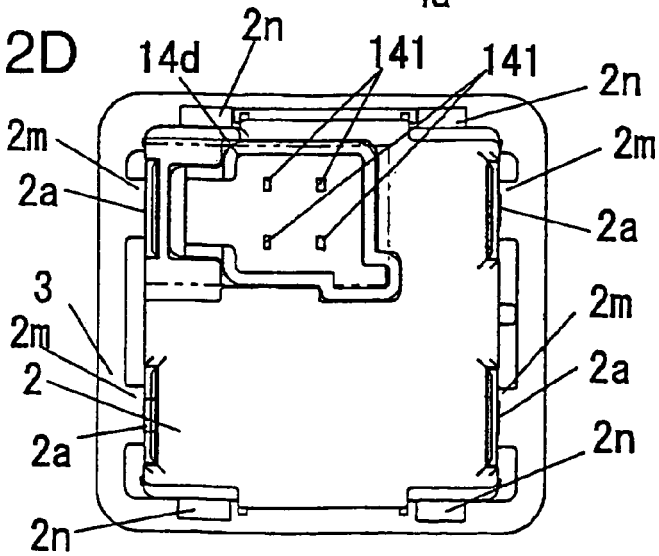
FIG. 2*d* is a rear view of the electrical outlet box of the embodiment of FIG. 1.
Figure 3:
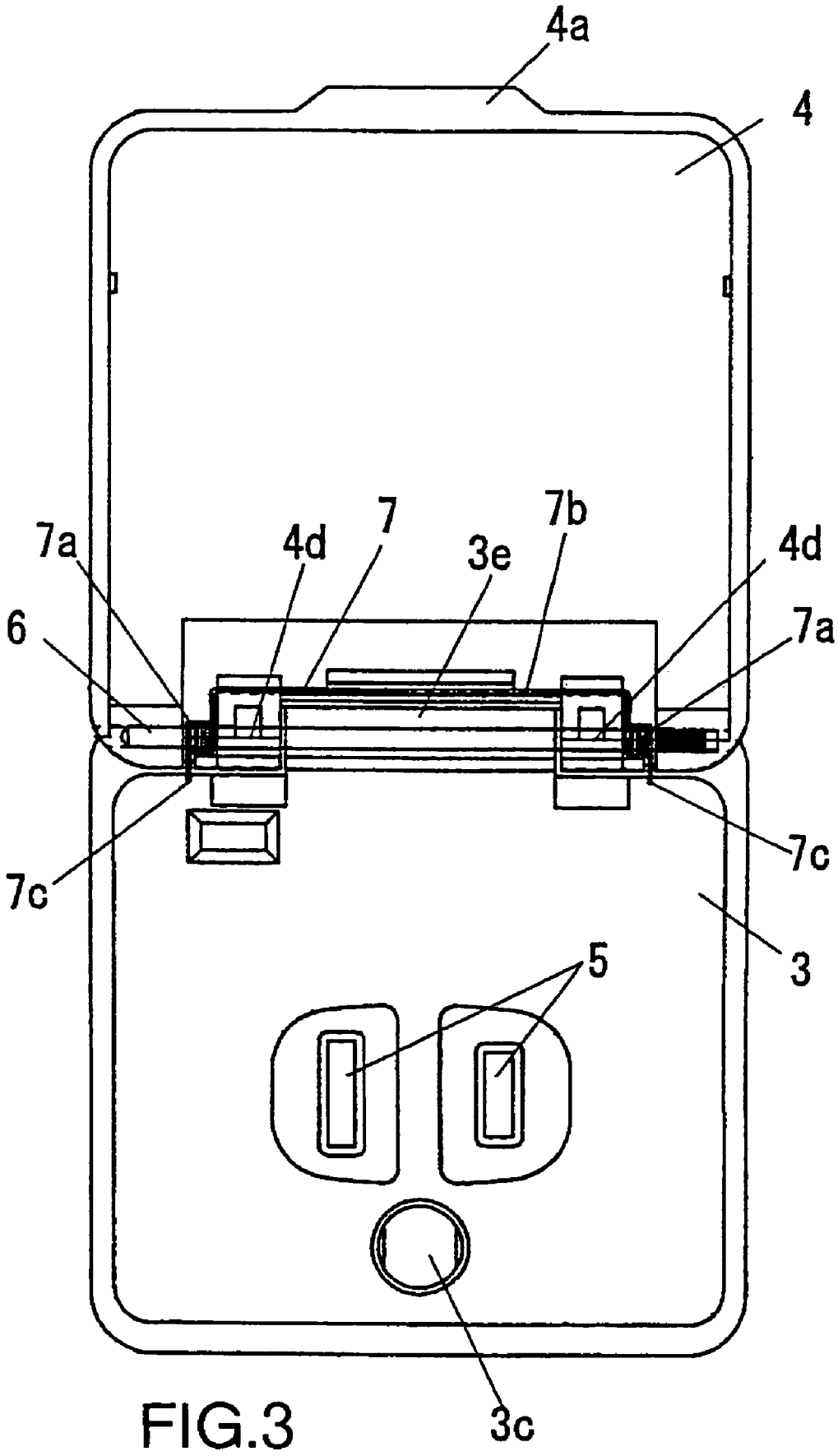
FIG. 3 is a front elevational view of the electrical outlet box of the embodiment of FIG. 1, with the external cover open.

As illustrated in FIGS. 1 through 3, the electrical outlet box of the present invention includes case 1 which is formed from the joining of body 2 and cover 3, and external cover 4 which pivots on one edge of case 1 to positions that expose or cover the front surface of cover 3 (the upper surface of cover 3 as shown in FIG. 1). The case 1 may have any suitable form and in the present embodiment has a rectangular shape. The body 2 may formed from any suitable material such as, for example, a synthetic resin.

Body 2, which in the present embodiment is a rectangular structure with an open front portion, houses two blade receivers 10 that contact voltage plug blade 100 and ground plug blade 101, respectively, of plug 'P' (shown in FIGS. 5*a*, 5*b*, 6*a*, and 6*b*) which are inserted through blade insertion slots 5 on cover 3, a pair of pivot levers 12 that pivot in one direction through respective contact with plug blades 100 and 101 inserted through plug blade insertion slots 5, a pair of return springs 13 that apply pressure against respective pivot levers 12 in the opposite direction to that in which the levers pivot through contact with plug blades 100 and 101, printed circuit block 14 which includes two microswitches 14*b*, each microswitch being equipped with lever 14*c* attached at one edge thereon in order to detect the pivoting movement of each pivot lever 12, and circuit base plate 14*a* to which connector 14*d* is attached, connector 14*d* serving as a signal terminal part to which external electrical wires are connected.

Figure 16:
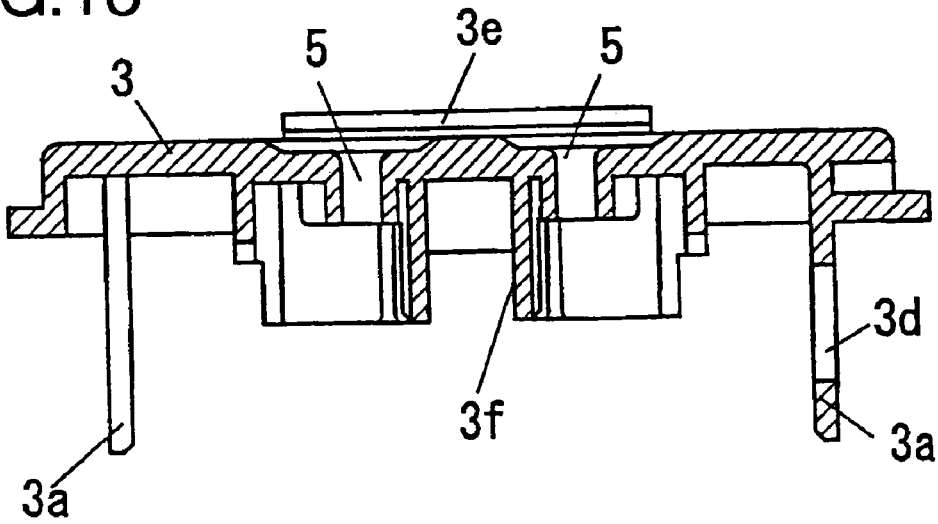
FIG. 16 is a cross sectional view of the cover of the embodiment of FIG. 1, from line B—B in FIG. 12.
Figure 17:
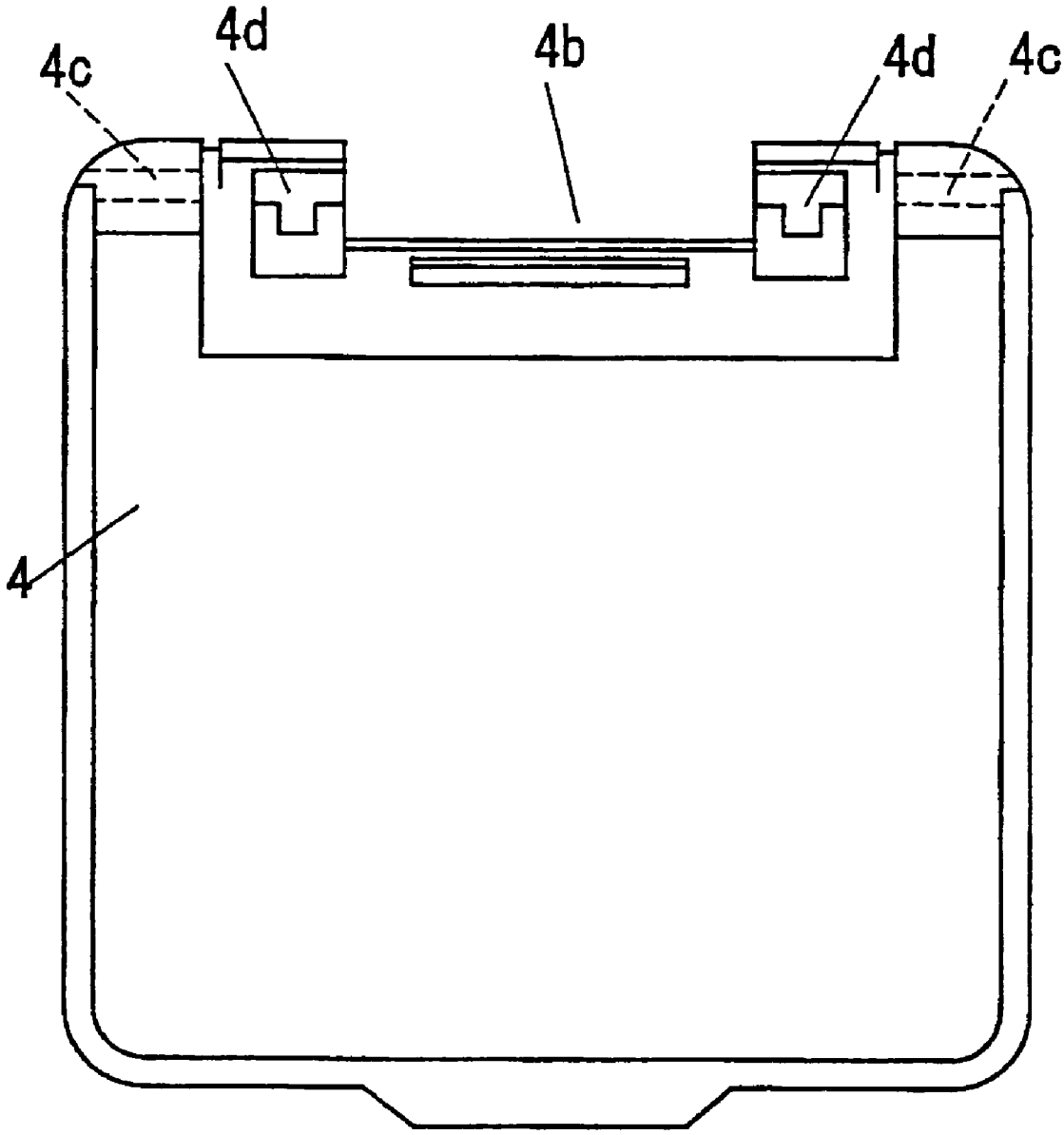
FIG. 17 is a rear elevational view of the external cover portion of the embodiment of FIG. 1.
Figure 18:
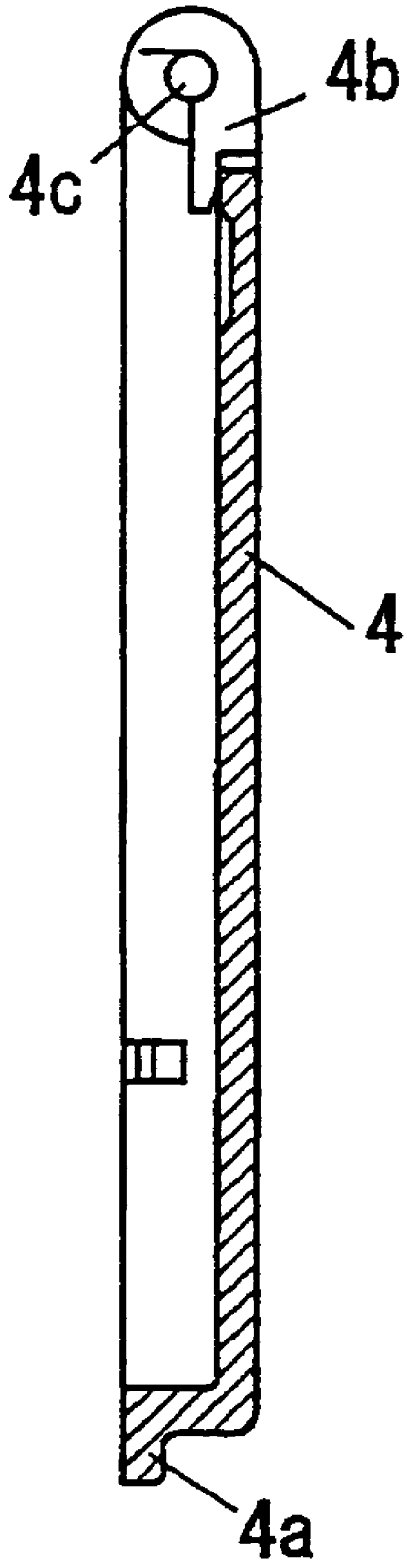
FIG. 18 is a cross sectional view of the external cover portion of the embodiment of FIG. 1.
Figure 19:
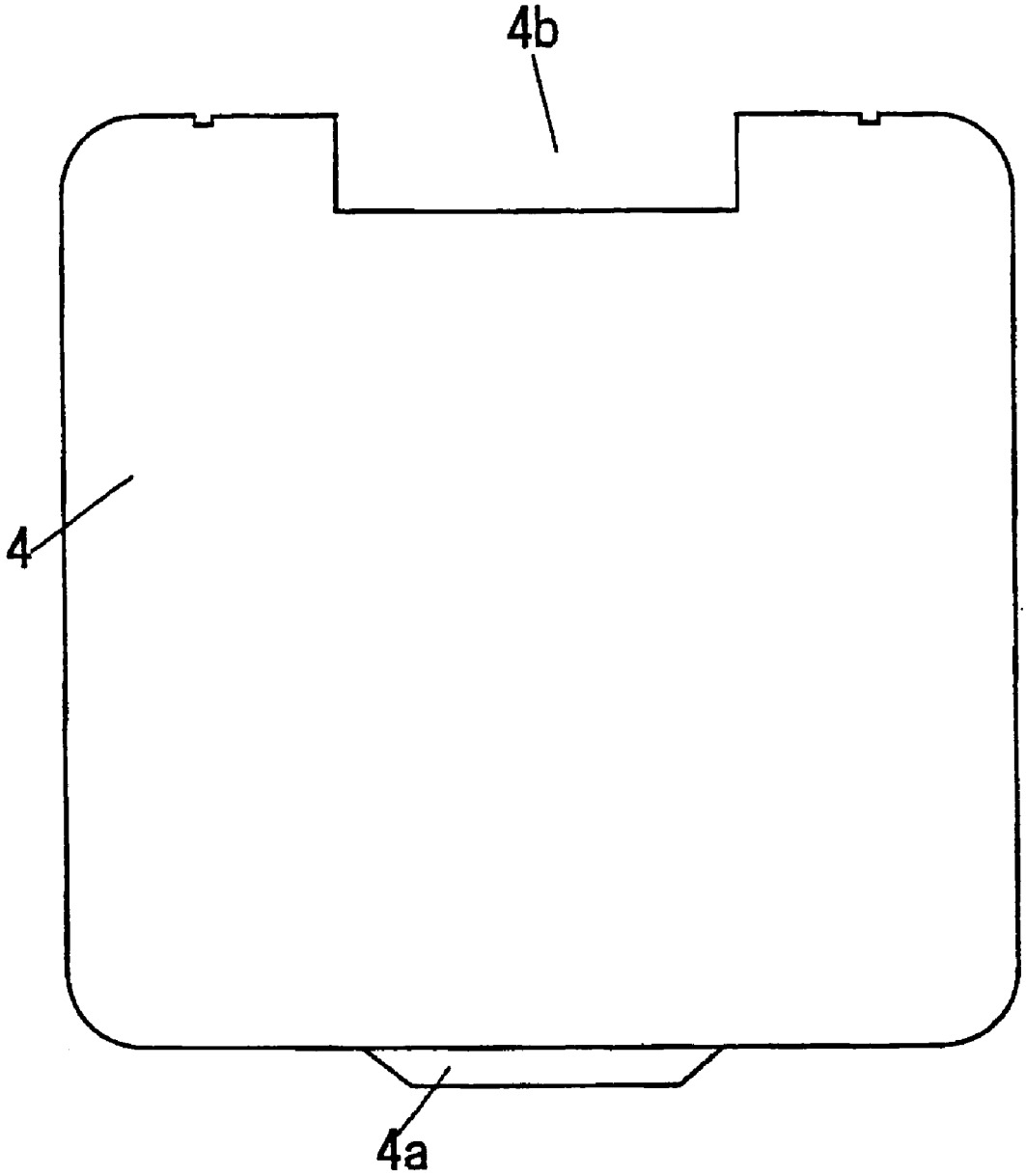
FIG. 19 is a front elevational view of the external cover portion of the embodiment of FIG. 1.
Figure 20:
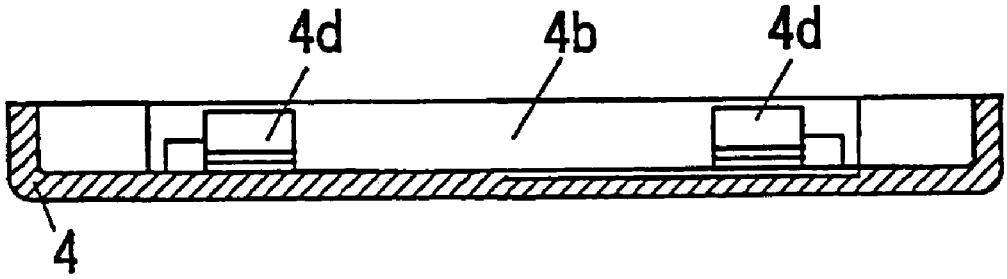
FIG. 20 is a cross sectional view of the external cover portion of the embodiment of FIG. 1.

Cover 3 is attached to and covers the front of body 2. In this embodiment, the electrical outlet box is a structure formed in an operating relationship to plug 'P' which includes mutually opposing plate-shaped plug blades 100 and 101 and, as shown in FIG. 3, the outlet box includes two rectangular-shaped blade insertion slots 5 in parallel orientation. Moreover, dummy hole 3*c* is provided adjacent to blade insertion slots 5 in order to allow the insertion of plugs equipped with a round grounding pin. Cylindrical guide part 3*f* (FIG. 16) extends from the inner surface of cover 3 around dummy hole 3*c*, and guide hole 2*p* (FIG. 7) is formed in body 2 as a connecting passage to cylindrical guide part 3*f*.

As shown in FIGS. 7 through 11, a pair of fore and aft extending assembly channels 2*m* (FIG. 8) are provided on two external sides of body 2, and assembly tab 2*a* projects from the bottom part of each channel 2*m*. As can be seen in FIGS. 12 through 16, a pair of rearward extending assembly latches 3*a* project from two edges of cover 3. Each aperture 3*d*, which is formed within each latch 3*a*, joins to each assembly tab 2*a*. Therefore, pressing cover 3 over body 2 results in each assembly tab 2*a* joining to an opposing aperture 3*d* to mutually connect cover 3 and body 2. With cover 3 and body 2 mutually joined, the edges of cover 3 extend outward over and beyond each side of body 2.

A pair of assembly lips 2*n* are formed on each of the two sides of body 2 not having assembly channels 2*m*. Case 1 may be provided in a panel (not shown) by insertion, from the body 2 side, into a rectangular mounting hole (not shown) provided in the panel and formed to the approximate dimensions of the external dimensions of body 2. The edge of the mounting hole is sandwiched between lips 2*n* and the edges of cover 3 to fixedly secure case 1 to the panel.

Moreover, hinge support 3*e*, into which hinge pin 6 is inserted, is formed on the edge of one of the two sides of cover 3 on which assembly latches 3*a* are not formed. As can be seen in FIGS. 3 through 14, hinge support 3*e* is a U-shaped boss from which both ends of hinge pin 6 projects to be exposed on the front side of cover 3. Spring 7 is attached to hinge pin 6. Spring 7 is a single spring form that includes an integral spring coil 7*a* formed at each end, the two spring coils 7*a* being mutually connected by U-shaped connecting part 7*b*, and a spring arm 7*c* that radially extends from the external end of each spring coil 7*a*. This structure thus allows hinge pin 6 to be inserted through both spring coils 7*a*, connecting member 7*b* to contact the rear surface of external cover 4, and spring arms 7*c* to be secured against cover 3.

External cover 4 is formed in the approximate same external configuration as cover 3 but of a size able to cover the entire front surface of cover 3. As shown in FIGS. 17 through 20, cutout portion 4*b*, which is formed within the part of cover 4 that confronts hinge support 3*e* on cover 3, allows the placement of hinge support 3*e* therein. External cover 4 includes hinge bosses 4*d*, through which the ends of hinge pin 6 pass, formed on each side of cutout portion 4*b*, and pin apertures 4*c*, located to accommodate the ends of hinge pin 6, into which the ends of hinge pin 6 are inserted. Each spring coil 7*a* is located between hinge boss 4*d* and pin aperture 4*c*. This structure allows the pivotal mounting of external cover 4 to cover 3 with spring 7 applying pressure in the direction that external cover 4 closes against cover 3. Further, lip 4*a* is formed on the edge of cover 4, opposite to cutout portion 4*b*, in order to provide a finger contacting portion through which external cover 4 can be opened and closed.

Figure 21:
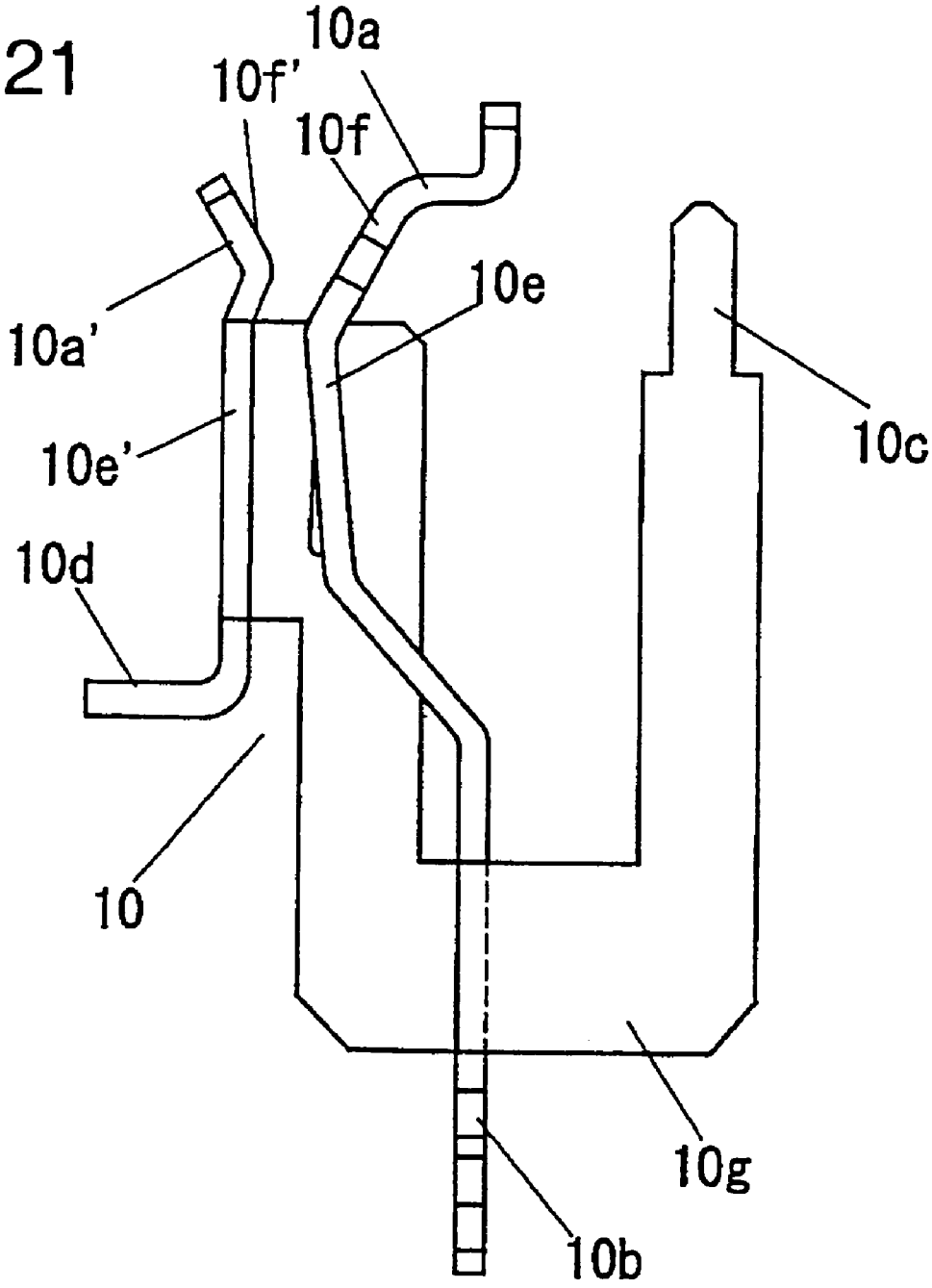
FIG. 21 is a front elevational view of the blade receiver portion of the embodiment of FIG. 1.
Figure 22:
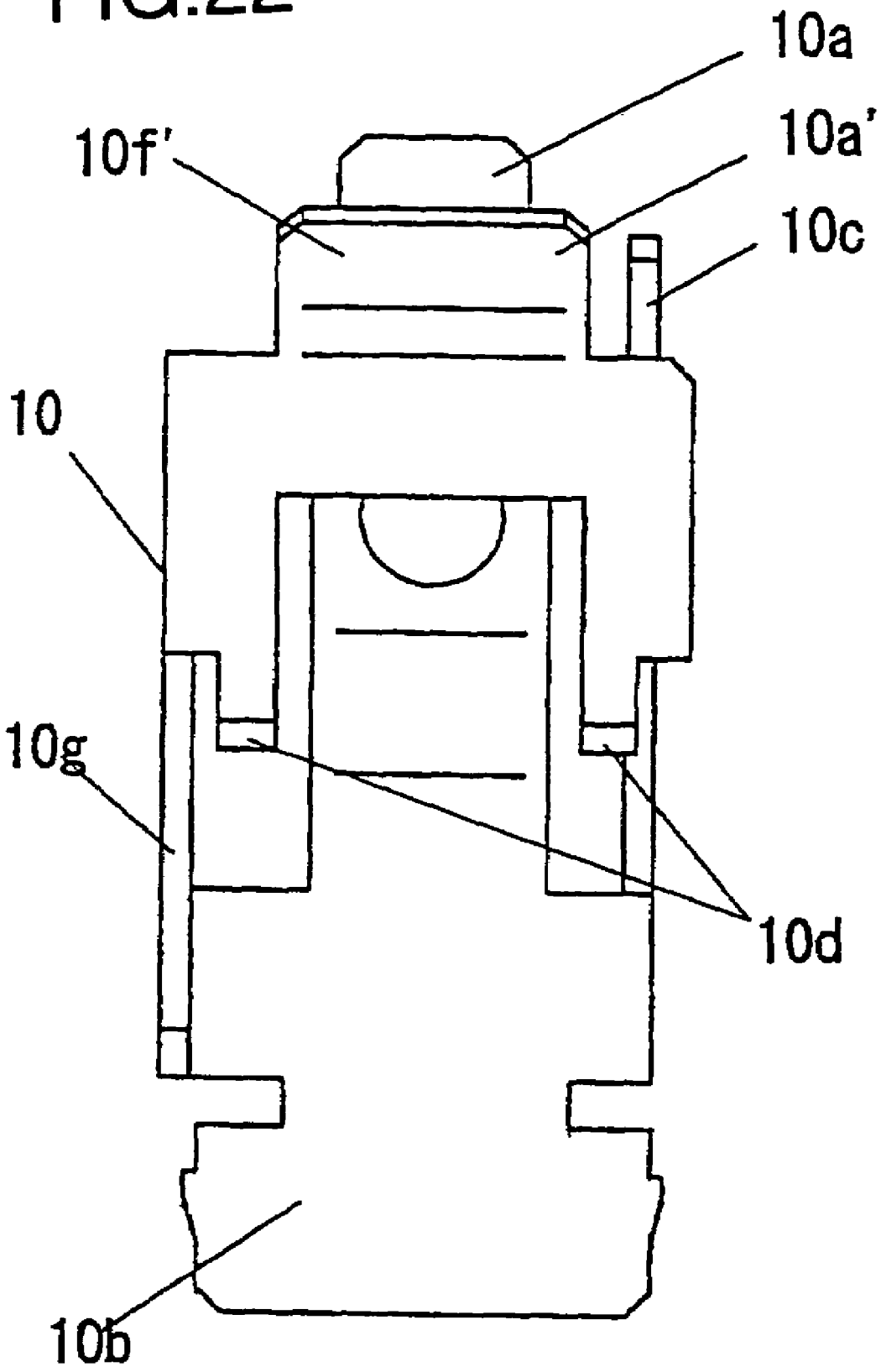
FIG. 22 is a left side elevational view of the blade receiver portion of the embodiment of FIG. 1.
Figure 23:
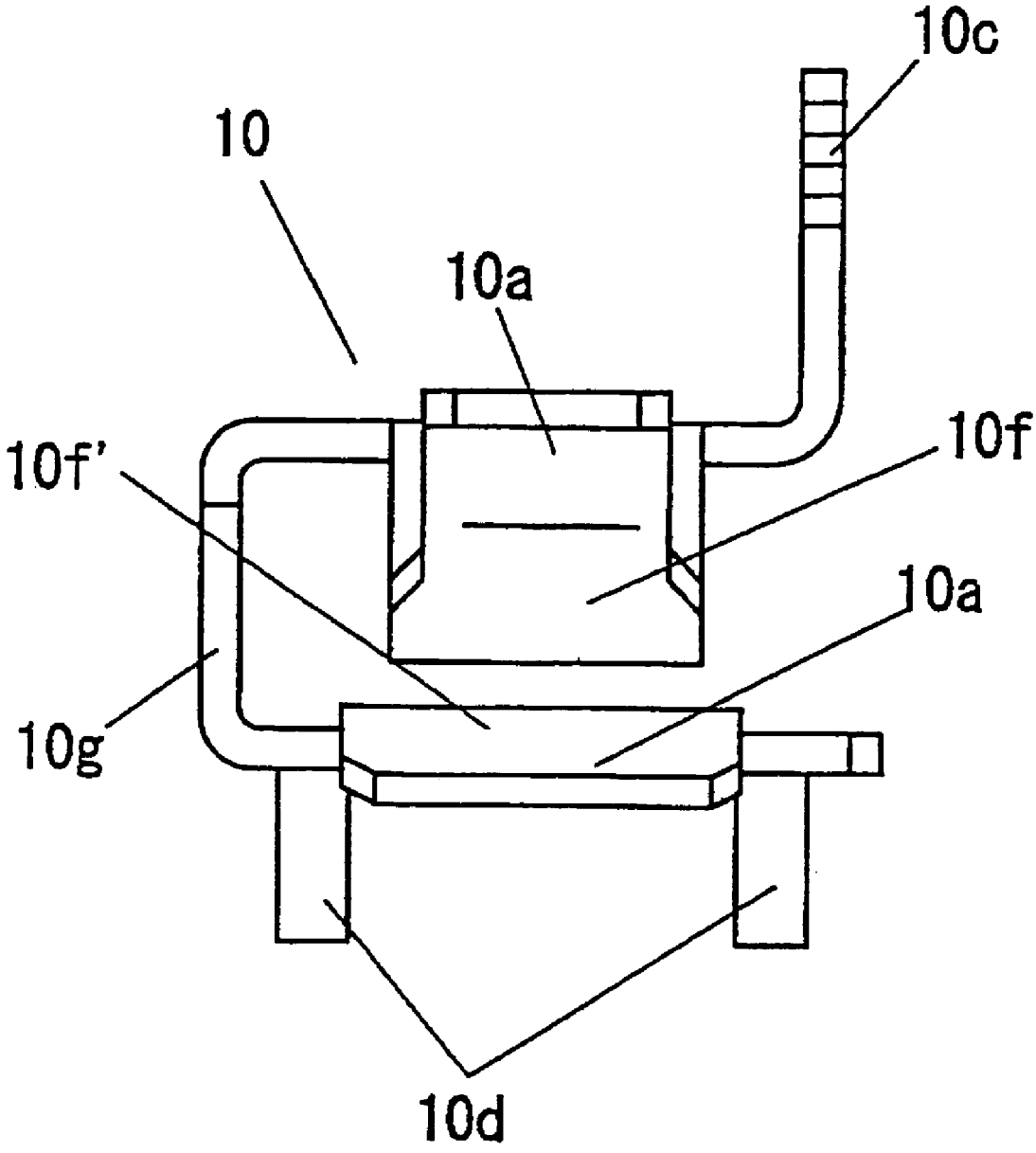
FIG. 23 is a plan view of the blade receiver portion of the embodiment of FIG. 1.
Figure 24:
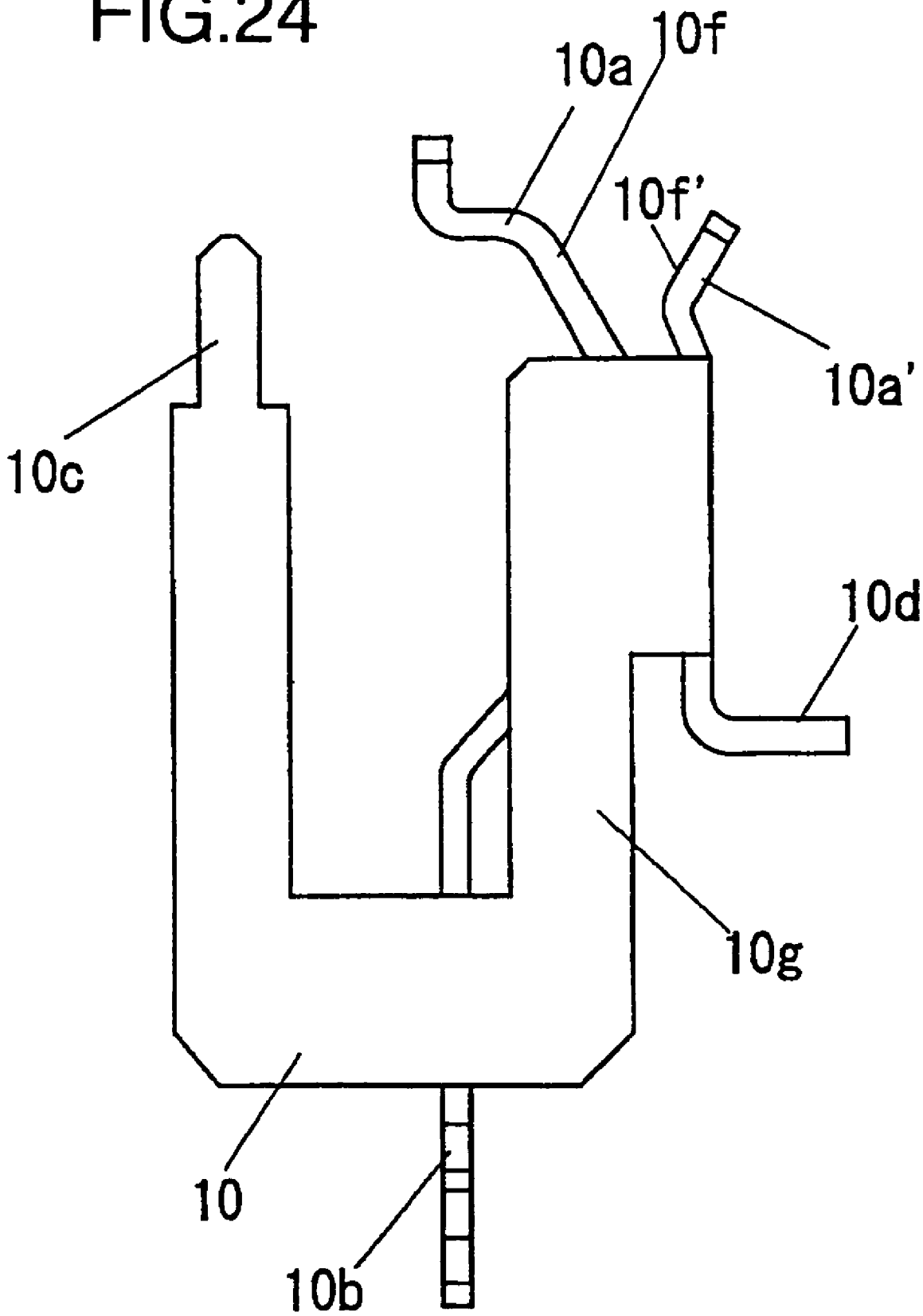
FIG. 24 is a rear elevational view of the blade receiver portion of the embodiment of FIG. 1.

As shown in FIGS. 21 though 24, blade receiver 10, a single electrically conductive metal strip formed to include first blade spring 10*a* and second blade spring 10*a*', is located adjacent to insertion slots 5 within case 1. Plug blades 100 and 101 are inserted into first and second blade springs 10*a* and 10*a*' within case 1 through insertion slots 5. The following description will refer to the vertically oriented blade receiver 10 shown in FIG. 21. As shown in FIG. 21, the upper end of blade receiver 10 faces cover 3 from where plug blades 100 and 101 are inserted. Blade springs 10*a* and 10*a*' include respective contact parts 10*e* and 10*e*' that press against the center portions of plug blades 100 and 101, the upper extremities of contact parts 10*e* and 10*e*' being respectively formed as inclined guide parts 10*f* and 10*f*' which widen the space there between as they extend upward. Blade spring 10*a* includes insertion part 10*b* that extends beneath contact part 10*e* to a point below blade spring 10*a*'. Open space is provided below blade spring 10*a*' with blade springs 10*a* and 10*a*' being part of the same structure through their mutual connection by joint plate 10*g*. Joint plate 10*g* is an approximately L-shaped member that extends from the lower part of first blade spring 10*a* upward to contact part 10*e*' of second blade spring 10*a*', and serves as a connecting part that joins blade springs 10*a* and 10*a*'. Connector plate 10*c* is formed as an approximate L-shaped member extending upward opposite to joint plate 10*g*, the upper end of connector plate 10*c* extending into body 2 to make contact with circuit base plate 14*a*. Moreover, two stop flanges 10*d*, to be described subsequently, extend from the lower end of blade spring 10*a*' in the opposite direction from blade spring 10*a*.

Figure 7:
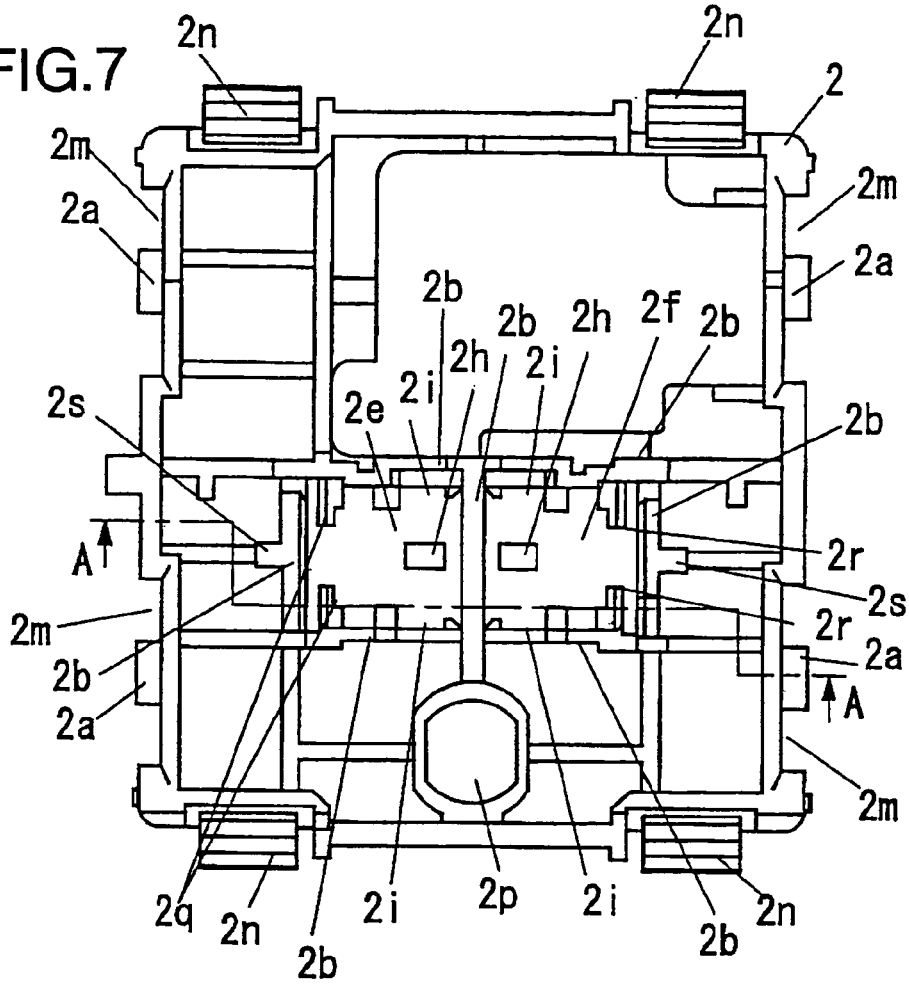
FIG. 7 is a front elevational view of the body portion of the embodiment of FIG. 1.
Figure 8:
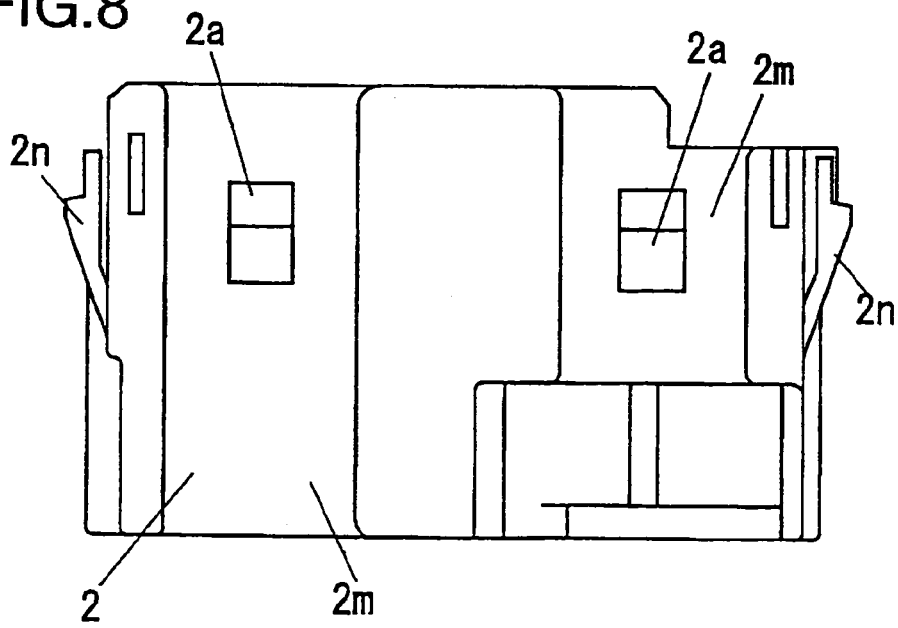
FIG. 8 is a side elevational view of the body portion of the embodiment of FIG. 1.
Figure 9:
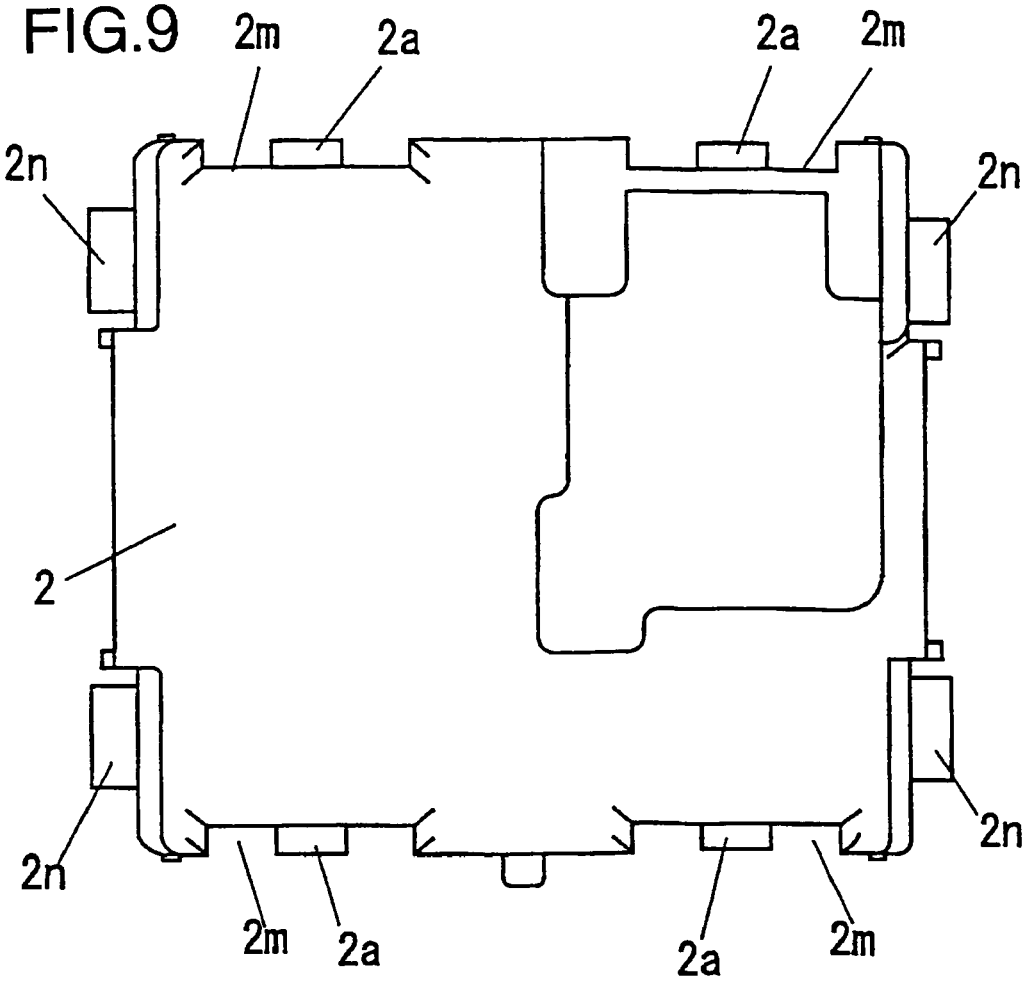
FIG. 9 is a rear elevational view of the body portion of the embodiment of FIG. 1.
Figure 10:
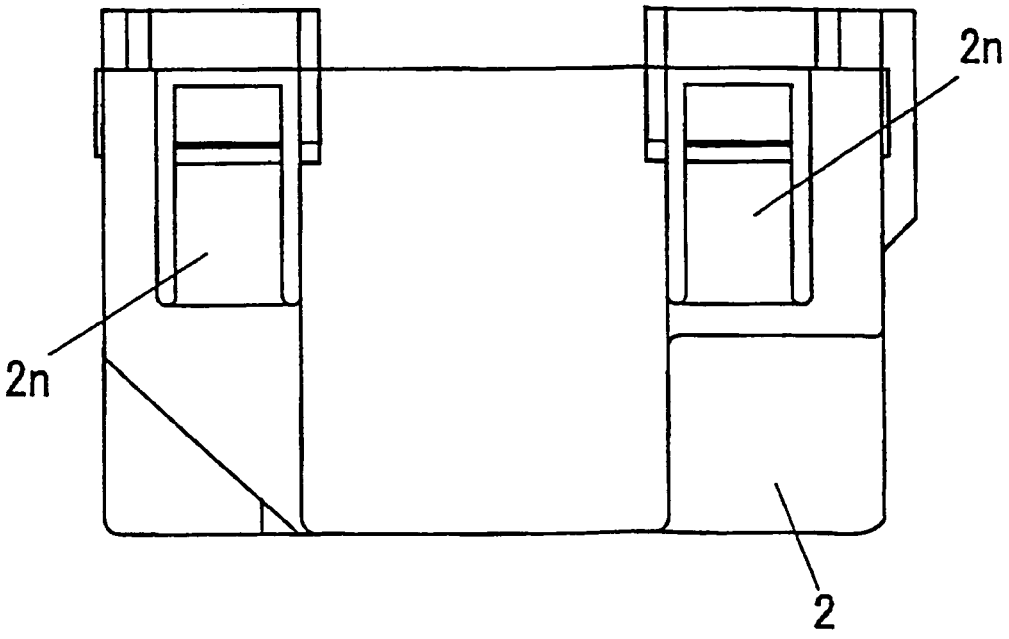
FIG. 10 is a plan view of the body portion of the embodiment of FIG. 1.
Figure 11:
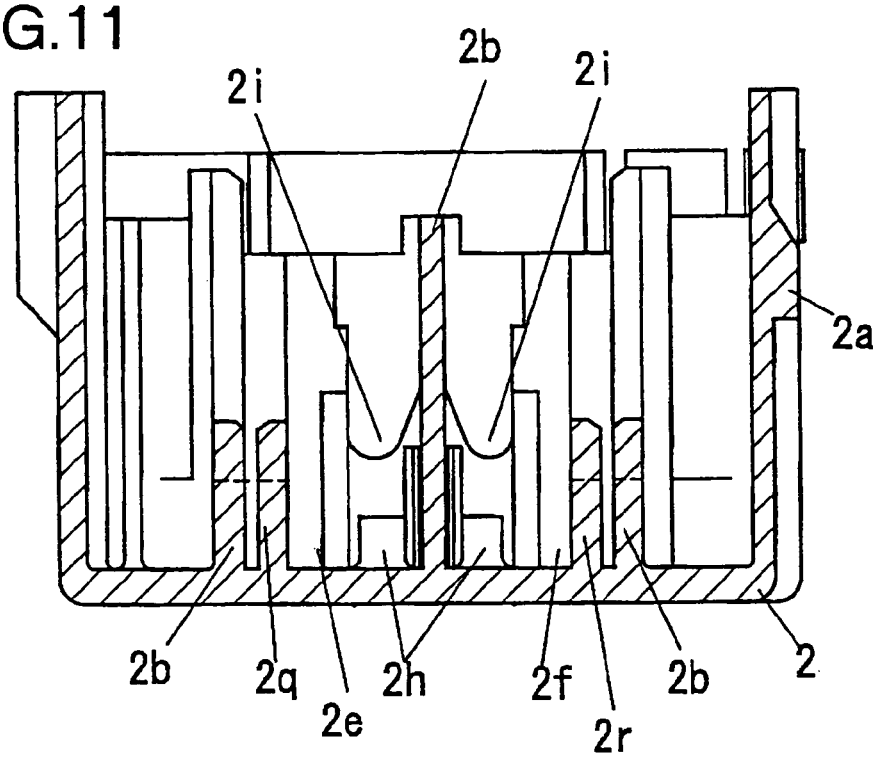
FIG. 11 is a cross sectional view of the body portion of the embodiment of FIG. 1, from line A—A in FIG. 7.
Figure 12:
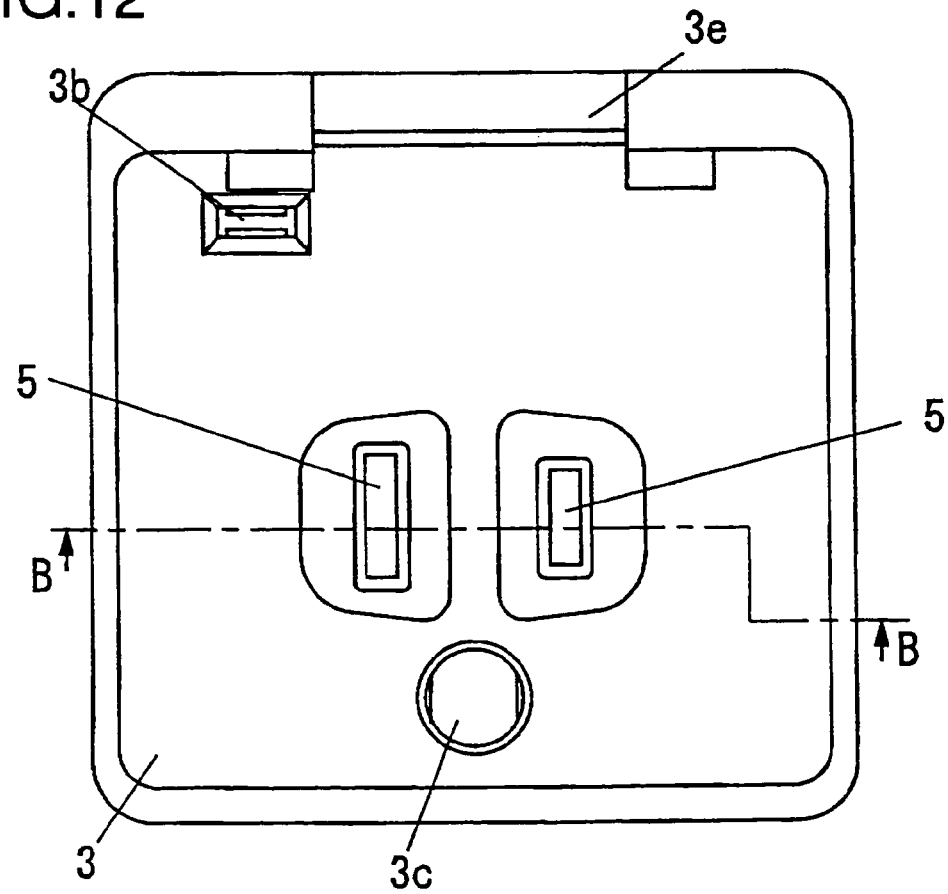
FIG. 12 is a front elevational view of the cover portion of the embodiment of FIG. 1.
Figure 13:
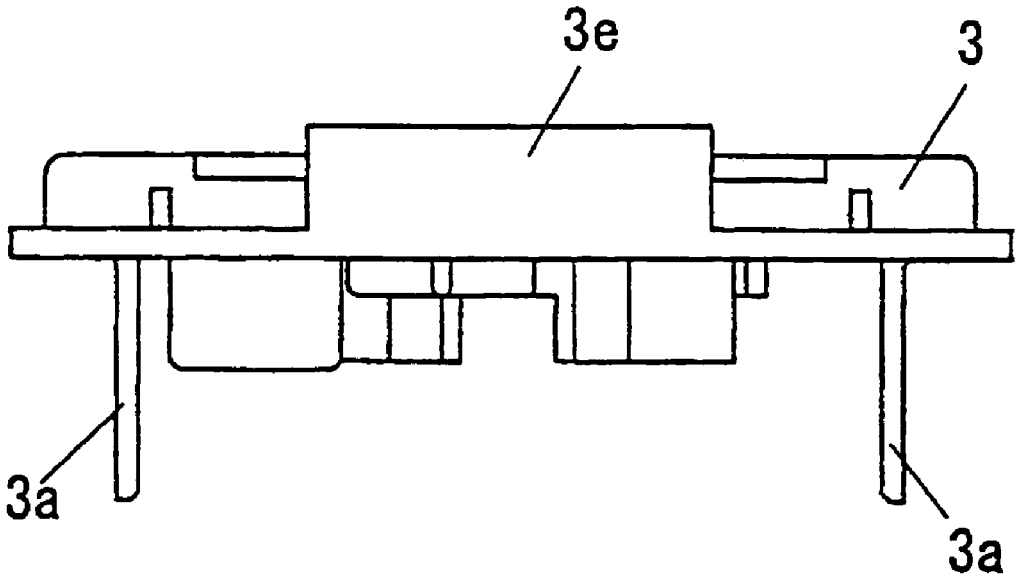
FIG. 13 is a plan view of the cover portion of the embodiment of FIG. 1.
Figure 14:
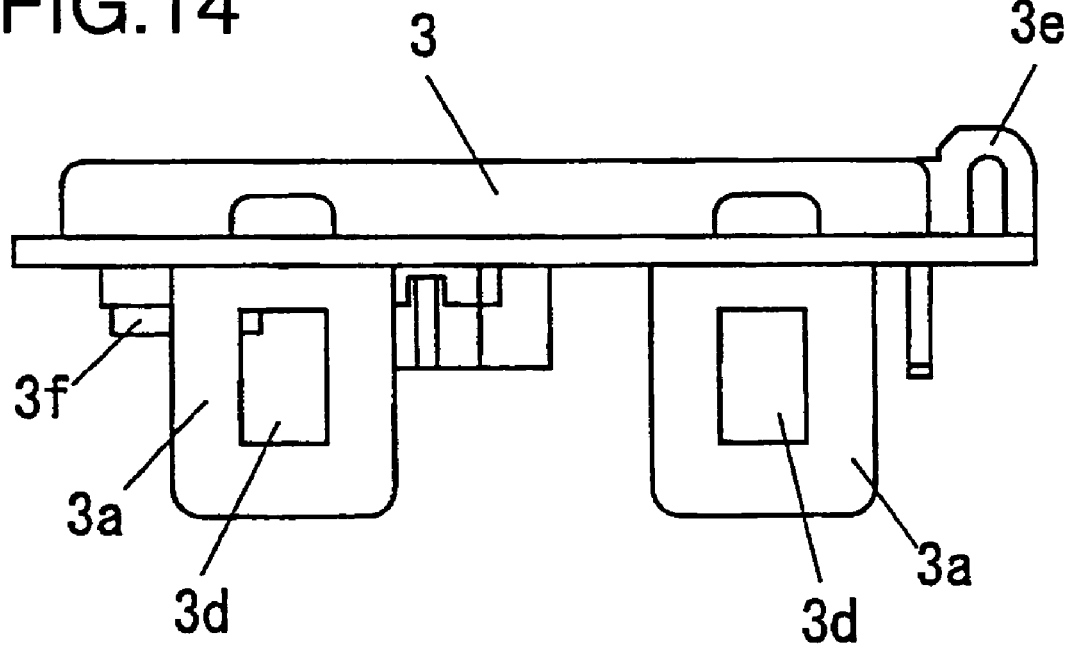
FIG. 14 is a side elevational view of the cover portion of the embodiment of FIG. 1.
Figure 15:
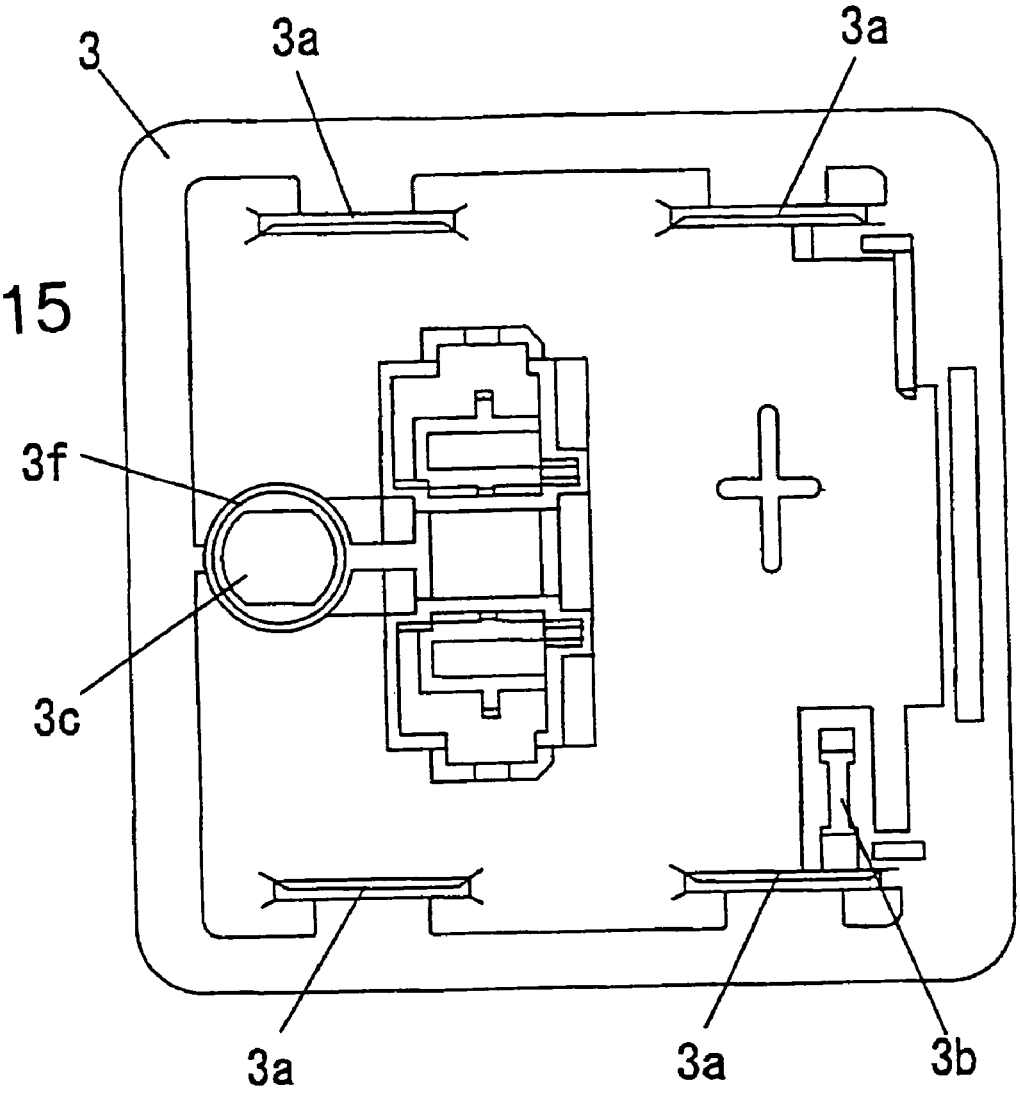
FIG. 15 is a rear elevational view of the cover portion of the embodiment of FIG. 1.

As illustrated in FIGS. 7 and 11, compartments 2*e* and 2*f*, which are located opposite blade insertion slots 5, are formed in the approximate center of the floor of body 2 by divider walls 2*b* which extend upward from the floor of body 2. Compartment 2*e* houses blade receiver 10 which conductively contacts voltage plug blade 100 when the blade is inserted through blade insertion slot 5, and voltage plug-side pivot lever 12 and return spring 13. Compartment 2*f* houses blade receiver 10 which conductively contacts grounding plug blade 101 when the blade is inserted through blade insertion slot 5, and grounding plug-side pivot lever 12 and return spring 13. Interval walls 2*q*, which project into compartment 2*e*, are aligned with divider wall 2*b* which is located on the side of body 2 on which assembly tabs 2*a* are formed, and interval walls 2*r*, which project into compartment 2*f*, are aligned with divider wall 2*b* which is located on the side of body 2 on which assembly tabs 2*a* are formed. Blade receivers 10 are located within body 2 through the insertion of their insertion parts 10*b* between divider wall 2*b* and interval walls 2*q*, and between divider wall 2*b* and interval walls 2*r*.

Figure 29:
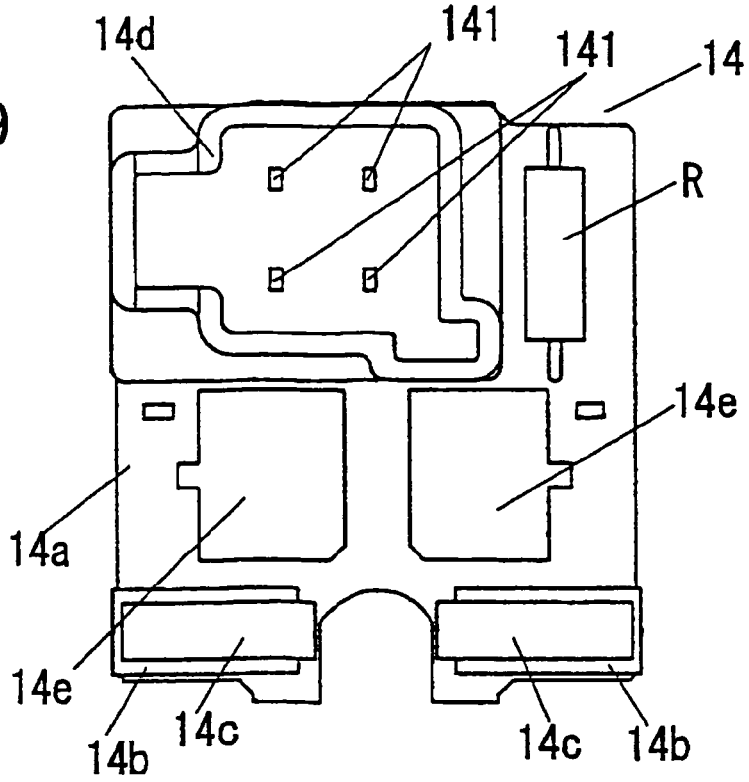
FIG. 29 is a front view of the printed circuit block of the embodiment of FIG. 1.
Figure 30:
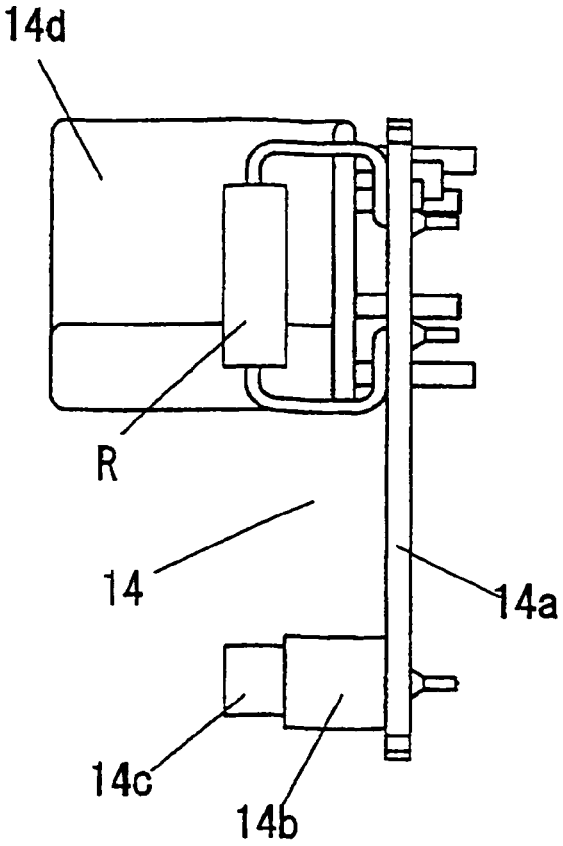
FIG. 30 is a side view of the printed circuit block of the embodiment of FIG. 1.
Figure 31:
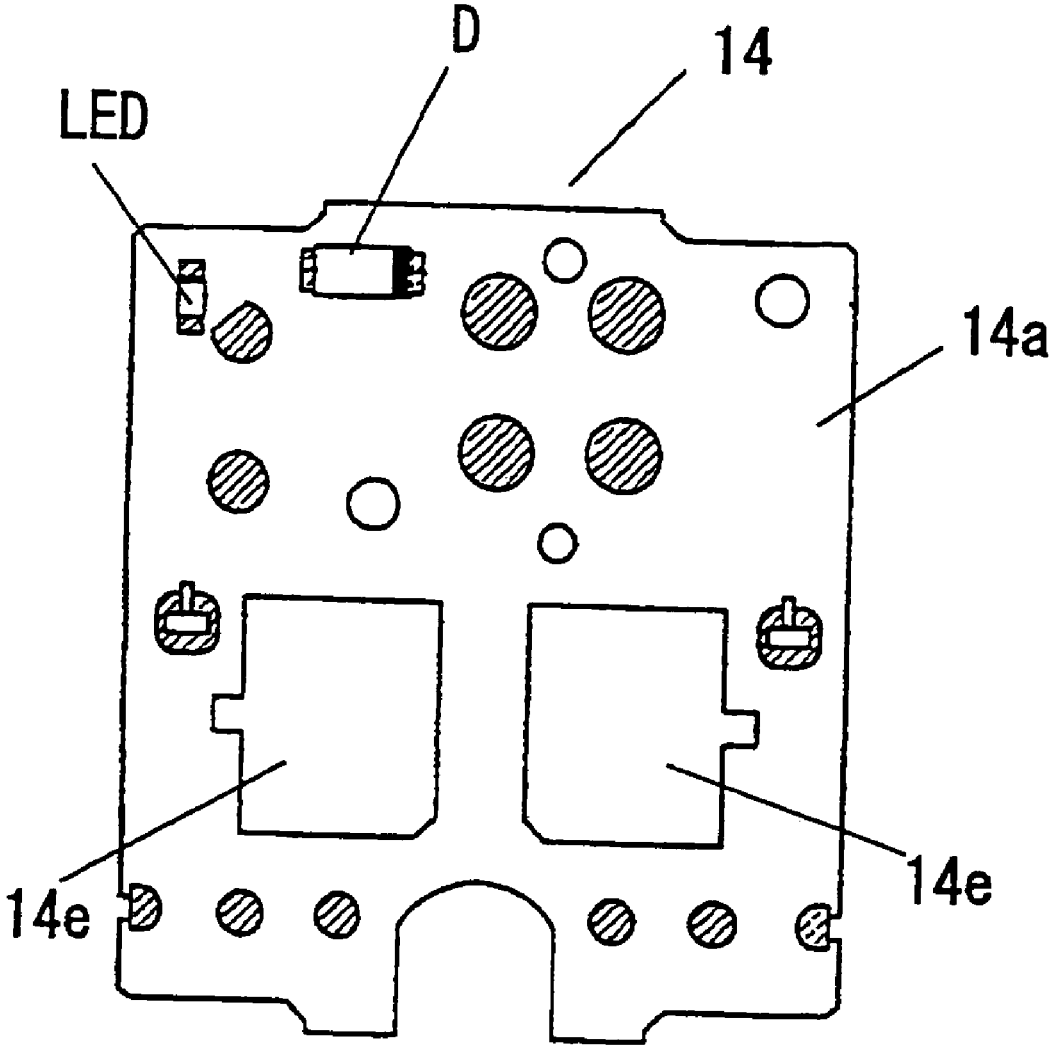
FIG. 31 is a rear view of the printed circuit block of the embodiment of FIG. 1.

FIGS. 29 through 31 illustrate printed circuit block 14 which includes circuit base plate 14*a* as the printed circuit substrate, and two insertion apertures 14*e* into which blade receivers 10 are inserted. Microswitches 14*b* are installed at the perimeter of circuit base plate 14*a* adjacent to the part where each blade receiver 10 is inserted, and connecter 14*d* is installed at a different portion of circuit base plate 14*a* than microswitches 14*b* in order to provide a connecting part for external electrical wires. Microswitches 14*b* and connector 14*d* face the floor (rear surface) of body 2 when printed circuit base plate 14*a* is installed therein. The two microswitches 14*b* are electrically connected in series with the two ends of the series circuit connected to two terminals 141 of connector 14*d*. Further, electrical current is supplied to blade receiver 10 through the other two terminals 141 of connector 14*d*.

Each microswitch 14*b* is provided for the purpose of detecting the presence of plug 'P' blades 100 and 101 in their respective blade receiver 10 (see FIGS. 5*a*, 5*b*, 6*a*, 6*b*). Microswitch 14*b* is constructed so that pressure applied to the free end of lever 14*c* results in an actuator opening or closing internal contact points to respective 'off' or 'on' positions. In this embodiment, plug blades 100 and 101, when inserted into blade receivers 10, press against pivot lever 12, thus causing pivot lever 12, which is held in position by return spring 13, to pivot against the free end of lever 14*c* of microswitch 14, and thus pressurize the actuator.

Figure 4A:
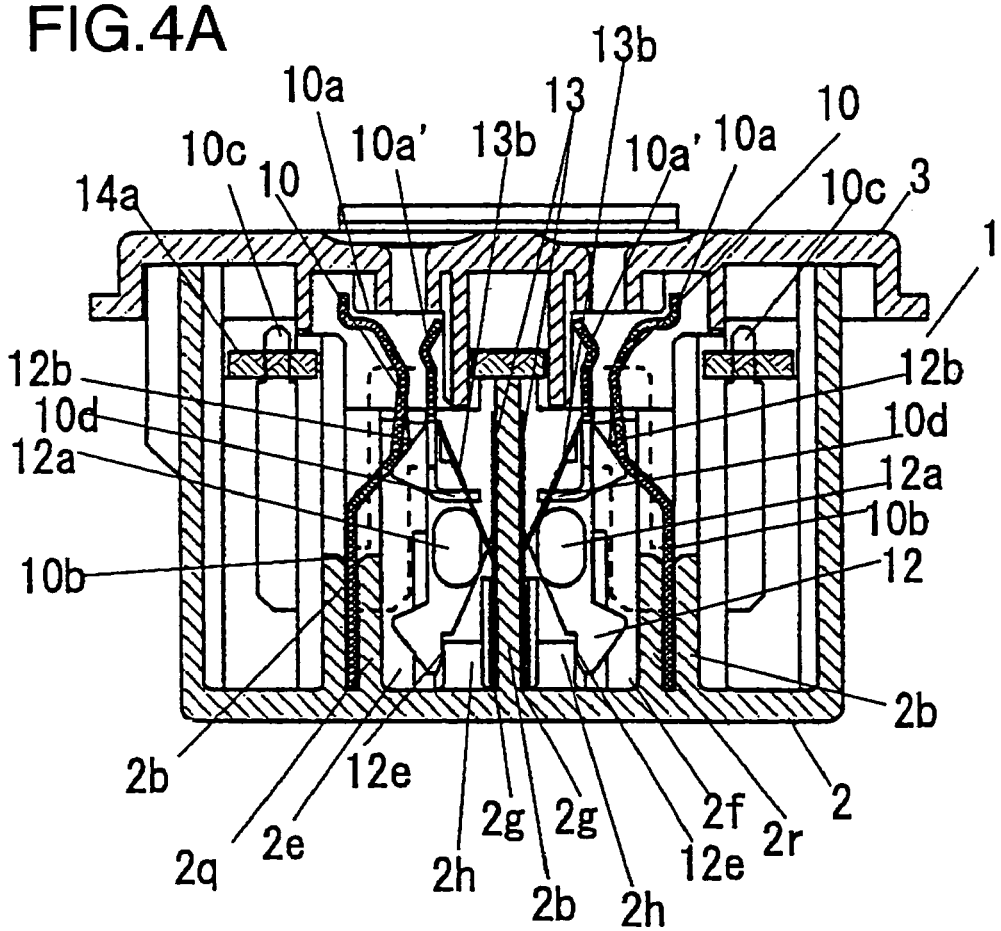
FIG. 4*a* is a cross sectional view of the blade side of the electrical outlet box of the embodiment of FIG. 1, before insertion of the plug blades.
Figure 4B:
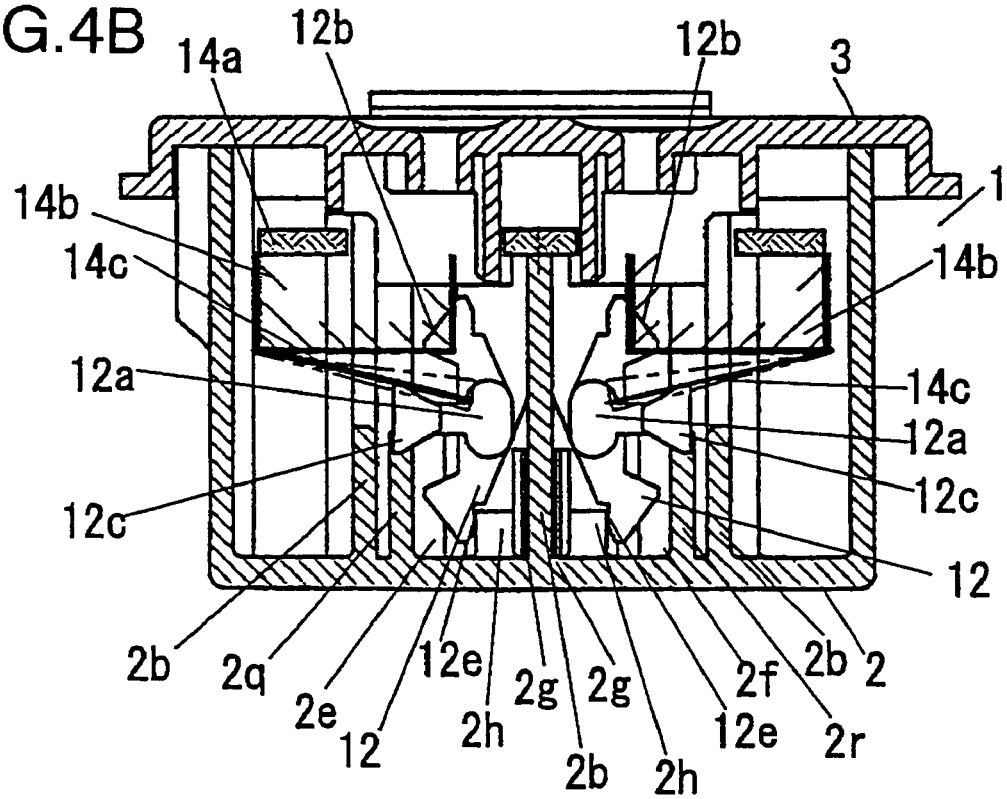
FIG. 4*b* is a cross sectional view of the switch side of the electrical outlet box of the embodiment of FIG. 1, before insertion of the plug blades.
Figure 5A:
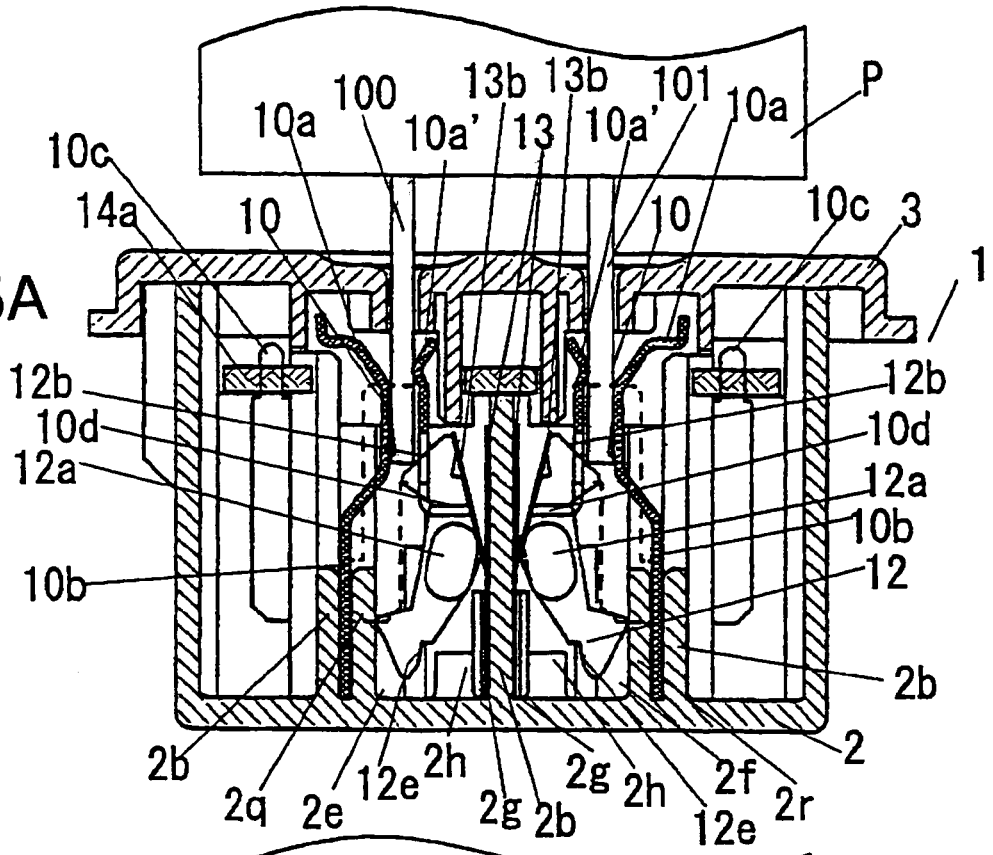
FIG. 5*a* is a cross sectional view of the blade side of the electrical outlet box of the embodiment of FIG. 1, during insertion of the plug blades.
Figure 5B:
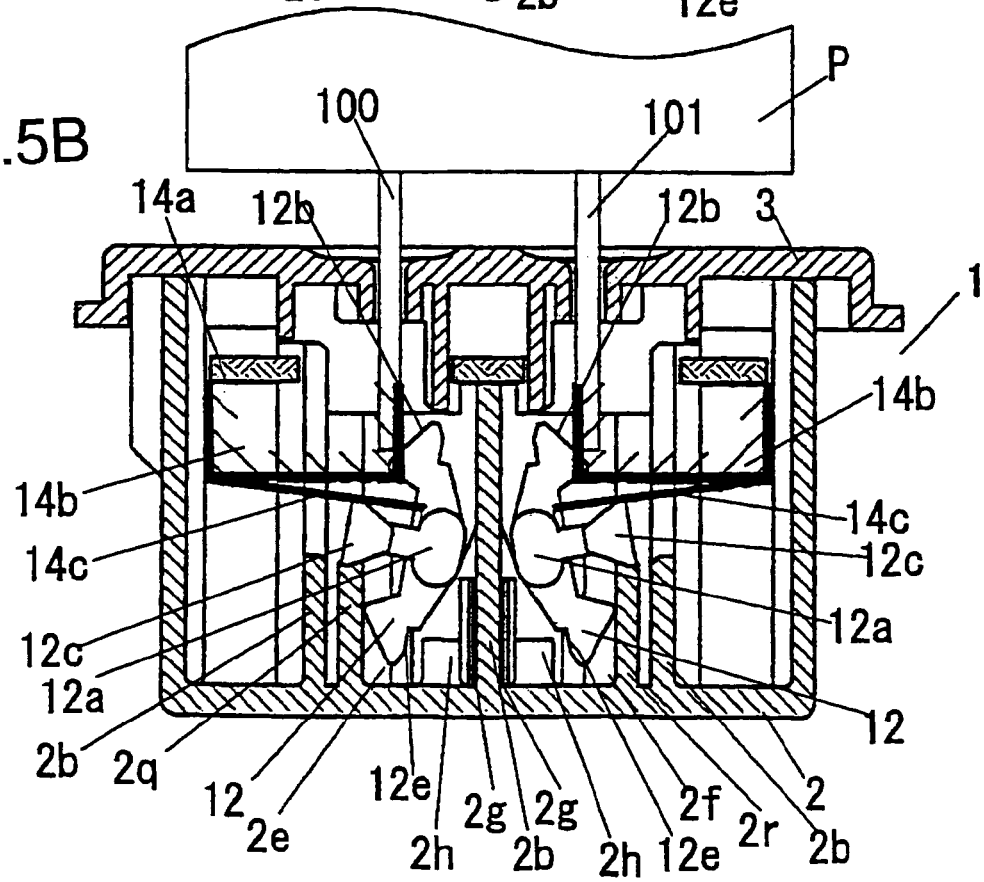
FIG. 5*b* is a cross sectional view of the switch side of the electrical outlet box of the embodiment of FIG. 1, during insertion of the plug blades.
Figure 6A:
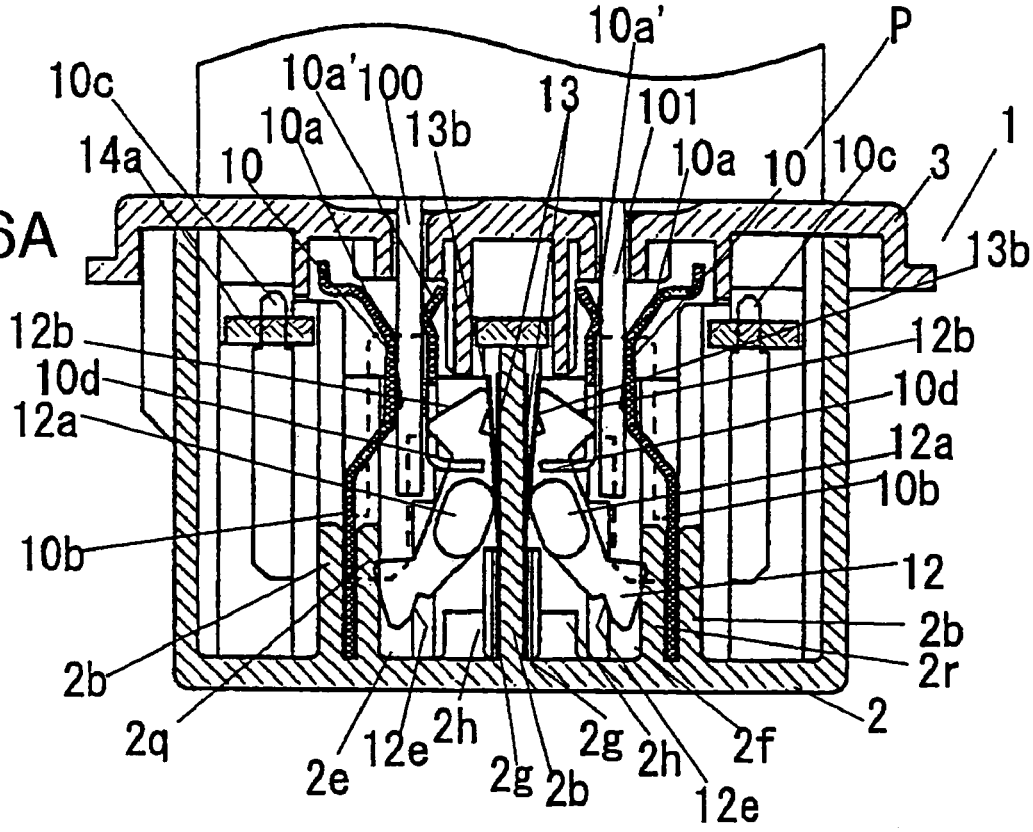
FIG. 6*a* is a cross sectional view of the blade side of the electrical outlet box of the embodiment of FIG. 1, after insertion of the plug blades.
Figure 6B:
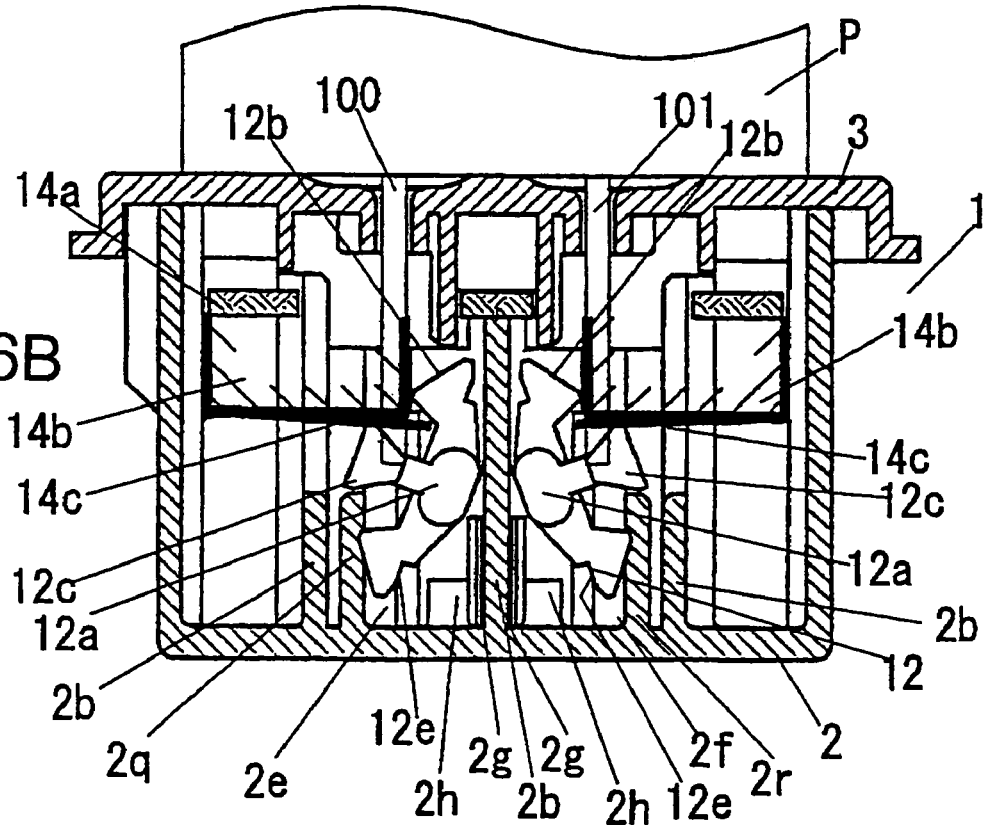
FIG. 6*b* is a cross sectional view of the switch side of the electrical outlet box of the embodiment of FIG. 1, after insertion of the plug blades.
Figure 25C:
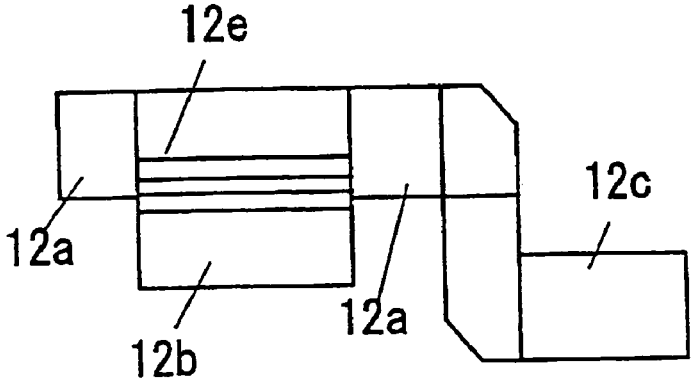
FIG. 25*c* is a plan view of the pivot lever portion of the embodiment of FIG. 1.
Figure 25A:
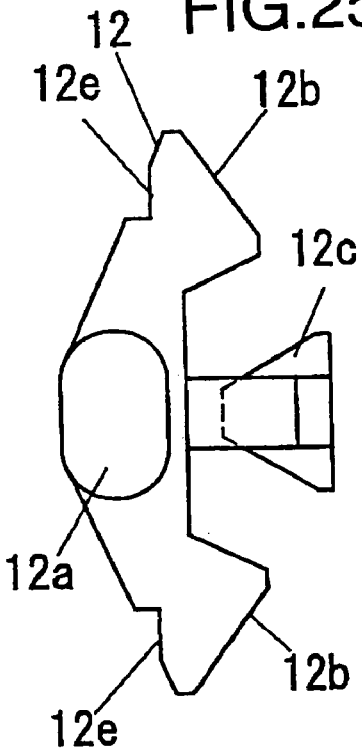
FIG. 25*a* is a front view of the pivot lever portion of the embodiment of FIG. 1.
Figure 25B:
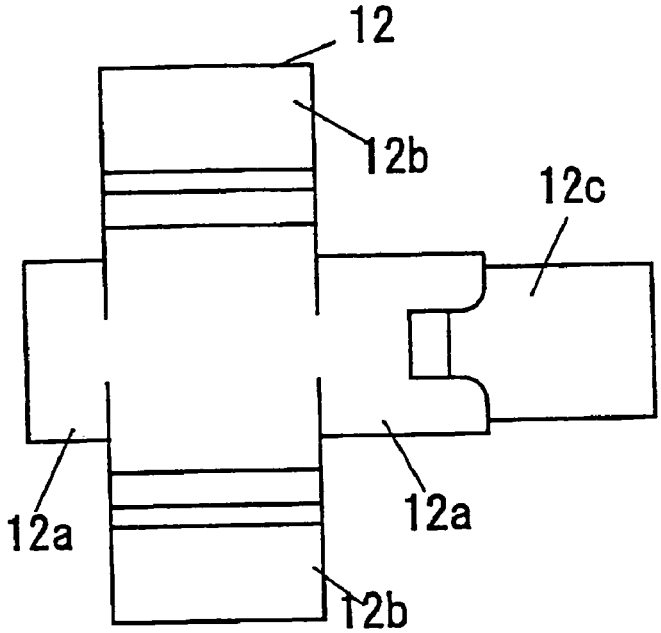
FIG. 25*b* is side view of the pivot lever portion of the embodiment of FIG. 1.
Figure 26:
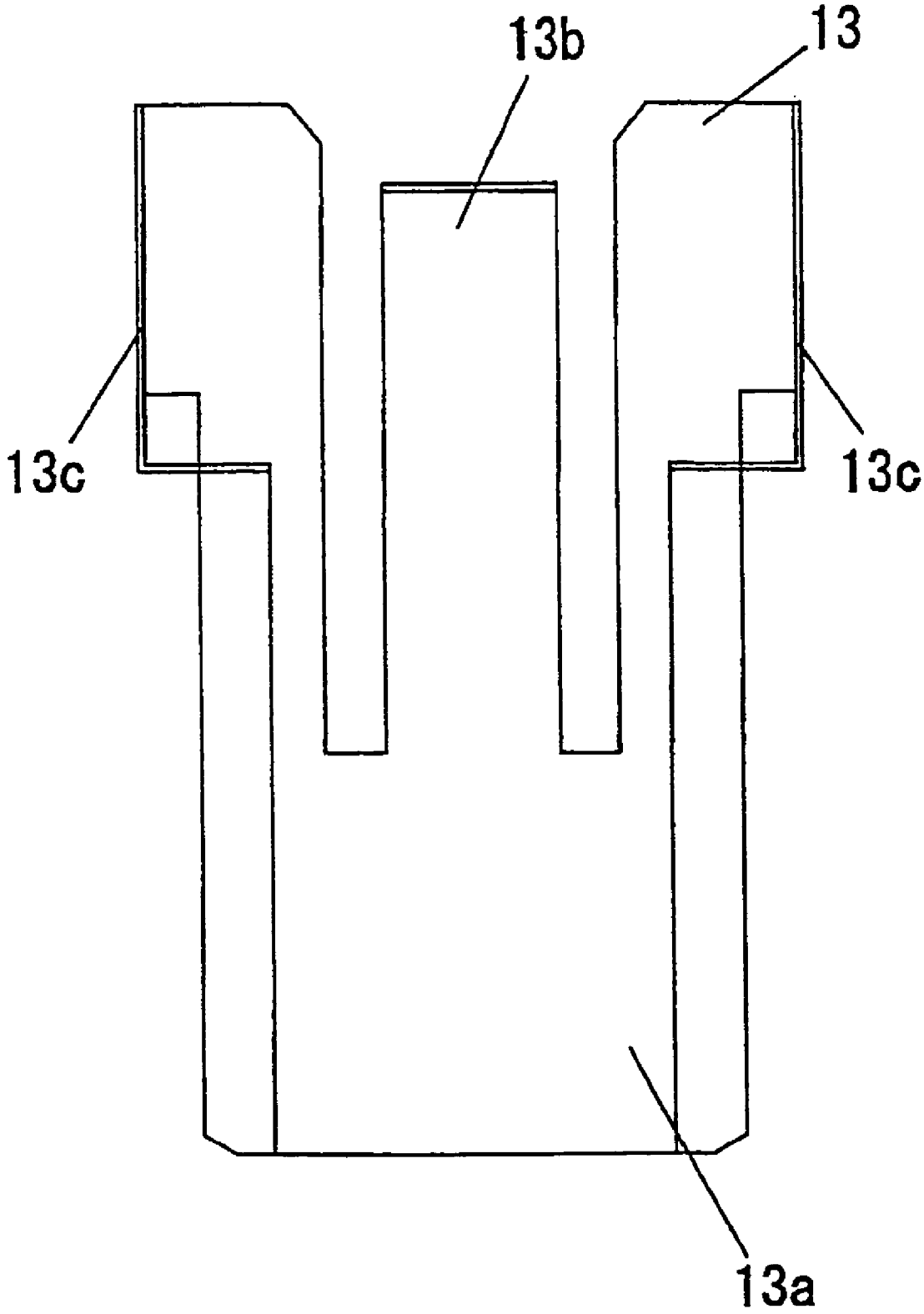
FIG. 26 is a front elevational view of the return spring portion of the embodiment of FIG. 1.
Figure 27:
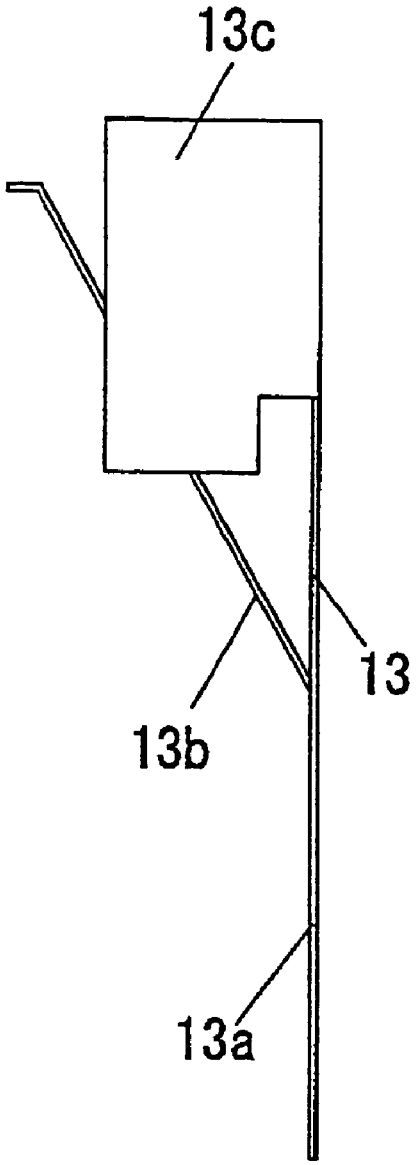
FIG. 27 is a side view of the return spring portion of the embodiment of FIG. 1.
Figure 28:
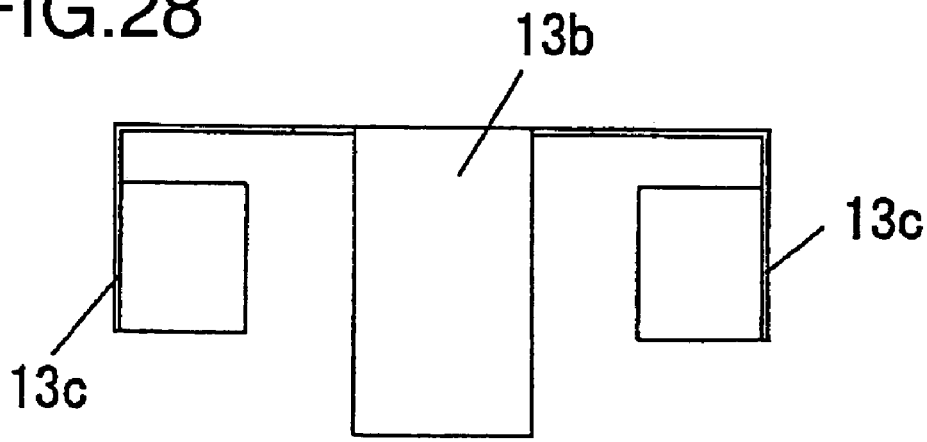
FIG. 28 is a plan view of the return spring portion of the embodiment of FIG. 1.

As illustrated in FIGS. 25*a*, 25*b*, and 25*c*, pivot lever 12 includes pivot shaft 12*a*, which is an oblong barrel-shaped shaft formed on both sides of pivot lever 12, around which pivot lever 12 rotates, switch operating part 12*c* which is an approximately L-shaped member that swings on the radial axis of pivot shaft 12*a*, and inclined blade sensor surfaces 12*b* which are symmetrically formed facing switch operating part 12*c* at the front and to the rear sides of pivot shaft 12*a*. Pivot lever 12, which is symmetrically formed in relation to pivot shaft 12*a* in the fore and aft directions, is provided in compartment 2*e* and 2*f* in the space opposite to insertion part 10*b* of blade receiver 10. As shown in FIGS. 4*a* and 4*b*, pivot shaft 12*a* is rotatably supported by body 2, and blade sensor surface 12*b* is exposed at the rear of the gap between blade springs 10*a* and 10*a*' with switch operating part 12*c* in contact with lever 14*c* and microswitch 14*b* in an open state. As shown in FIG. 11, pivot lever 12 is housed within body 2 through the insertion of pivot shaft 12*a* into pivot recesses 2*i*, the upper side of pivot shaft 12*a* being exposed, and the lower side residing and being pivotable within pivot recesses 2*i* which gradually narrow.

Return spring 13 (shown in FIGS. 4*a*, 4*b*, and 26 through 28) includes spring arm 13*b* which extends from the front edge of approximately rectangular-shaped spring base 13*a*, spring arm 13*b* bent in a direction toward pivot lever 12. Spring base 13*a*, which extends to the rear from spring arm 13*b*, is inserted into channel 2*g* which is formed along the rear portion of divider wall 2*b* that divides compartments 2*e* and 2*f* at the approximate mid-point of body 2. Thus installed, spring arm 13*b* maintains contact with the front part of oval-shaped pivot shaft 12*a* and the front part of pivot lever 12. Therefore, when plug blades 100 and 101 are not present in blade insertion slots 5, the pressure applied by spring arm 13*b* maintains pivot lever 12 at the 'off' position of lever 14*c* of sensor switch 14*b*. At this time, the force applied by return spring 13 is sufficient to prevent vibration and shocks from moving pivot lever 12.

The following will describe, with reference to FIGS. 5*a*, 5*b*, 6*a*, and 6*b*, the mechanisms that operate when plug blades 100 and 101 are inserted into blade insertion slots 5. Inserting plug blades 100 and 101 through blade insertion slots 5 and between spring blades 10*a* and 10*a*' of each respective receiver blade 10 will bring plug blades 100 and 101 into contact with inclined sensor surfaces 12*b* on pivot levers 12. The tips of plug blades 100 and 101 press against inclined sensor surfaces 12*b* which convert the blade insertion force to an intersecting directional force (the horizontal direction as shown in FIGS. 5 and 6) that opposes the direction of pressure applied by return spring 13 to pivot lever 12, thus resulting in the top of pivot lever 12 pivoting toward the center of body 2 as inclined sensor surfaces 12*b* slide against plug blades 100 and 101. The vertically pivoting movement of pivot lever 12 moves switch operating part 12*c* against lever 14*c* of sensor switch 14*b*, thus pressing lever 14*c* to the 'on' position at which the contact points within sensor switch 14*b* close (see FIGS. 5*a*, 5*b*). Therefore, the complete insertion of plug blades 100 and 101 through each pair of blade springs 10*a* and 10*a*' results in the further pivoting movement of pivot lever 12 which in turn pushes lever 14*c* of sensor switch 14*b* to the 'on' position at which the contact points in the switch close (see FIGS. 6*a* and 6*b*). Withdrawing plug blades 100 and 101 from blade insertion slots 5 results in return spring 13 pivotably pushing pivot levers 12 in the opposite direction to that when blades 100 and 101 were inserted, thus allowing lever 14*c* of sensor switch 14*b* to return to the 'off' position in which the contact points are open.

As previously noted, two microswitches 14*b* are provided, one at each of the two blade receivers 10, and the contact points of microswitches 14*b* are wired in series. To be more specific, output of the series-wired contact point circuit will activate when plug blades 100 and 101 are inserted into blade receivers 10, but the insertion of only one plug blade 100 or 101 (purposefully or not) into only one blade receiver 10 will prevent the circuit from activating. Moreover, because the activation signal sent to an external device through terminal connector 14*d* has been obtained from the series-wired contact point circuit that includes both microswitches 14*b*, that signal can be transmitted through only two terminals 141 even though the insertion condition of both plug blade 100 and 101 is monitored. The output signal is timed to activate when plug blades 100 and 101 are being withdrawn but are still in contact with blade receivers 10. In other words, the contact point operation of each microswitch 14*b* is timed so that the microswitch will not activate if plug blades 100 and 101 have not been sufficiently inserted but are still making contact with blade receivers 10. The microswitch contact points will activate, however, when plug blades 100 and 101 have been sufficiently inserted.

Figure 41:
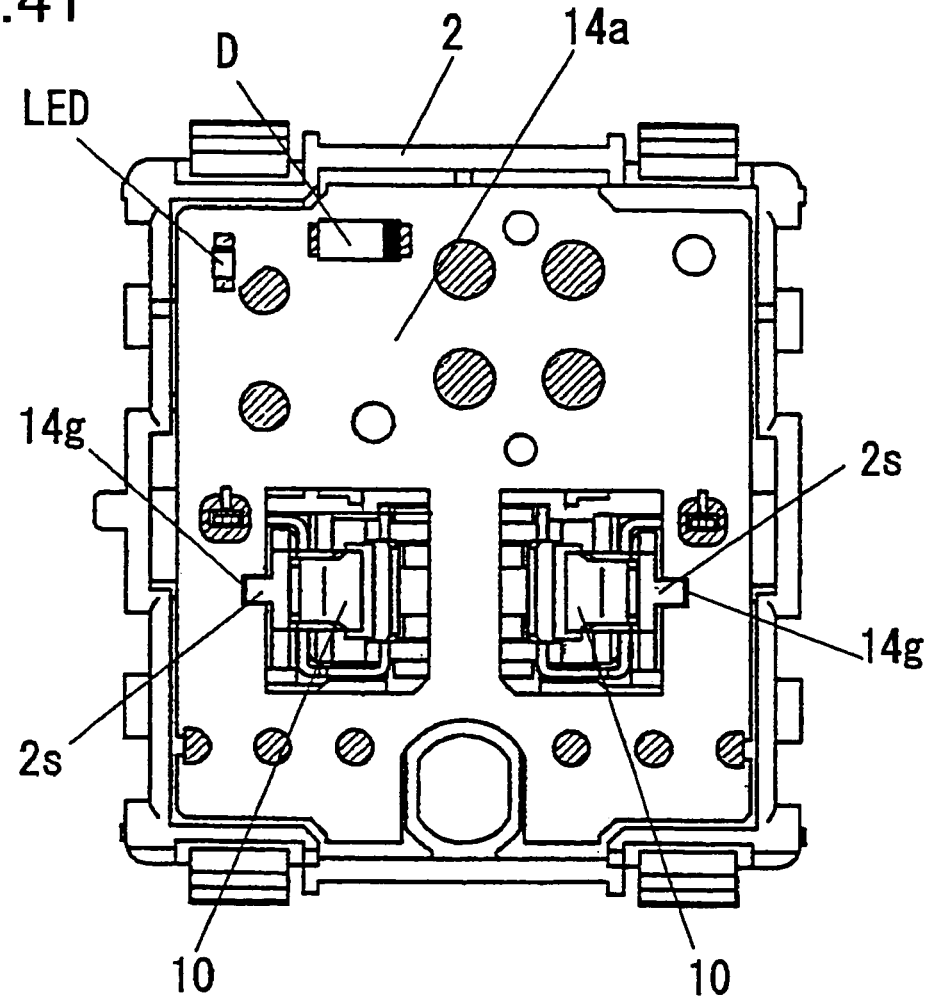
FIG. 41 is a plan view of the printed circuit block installed in the body of the embodiment of FIG. 21.

Furthermore, as previously noted, connector 14*d* provides an electrical connection from terminal 141 to blade receiver 10. As shown in FIG. 41, inverter circuit INV converts electrical power from vehicle-mounted battery 'B' into alternating current supplied to blade receiver 10 through connector 14*d*. Inverter circuit INV includes DC/AC conversion circuit 300 which converts direct current from battery 'B' into 100 volts alternating current, and controller 301 which is able to switch DC/AC conversion circuit 'on' and 'off'. When the output from the microswitch circuit, in which both microswitches 14*b* are wired in series, assumes an 'on' state, controller 301 activates DC/AC conversion circuit 300 to supply 100 volts of alternating current, and will deactivate DC/AC conversion circuit 300 to stop the supply of AC current when the output from the series-wired microswitch circuit assumes an 'off' state. Thus, the output from the contact points of two microswitches 14*b*, which is applied through a series-wired circuit, is used to control the supply of power from inverter circuit INV to blade receivers 10. As a result of the previously described contact point output timing, it becomes possible to switch the supply of current from inverter circuit INV to blade receivers 10 'on' or 'off' while plug blades 100 and 101 are still in contact with blade receivers 10. In other words, when plug blades 100 and 101 are inserted, inverter circuit INV supplies current to blade receivers 10 only when blades 100 and 101 are in electrically conductive contact with blade receivers 10. When plug blades 100 and 101 are withdrawn, current from inverter circuit INV to blade receivers 10 is turned off before blades 100 and 101 separate from blade receivers 10 to prevent electrical arcing between blade receivers 10 and plug blades 100.

Furthermore, a dependable plug blade detection function is provided because pivot lever 12 is formed as a rigid member able to consistently activate lever 14*c* of microswitch 14*b* even when plug blades 100 and 101 are inserted into blade insertion slots 5 at an angle.

Figure 32A:
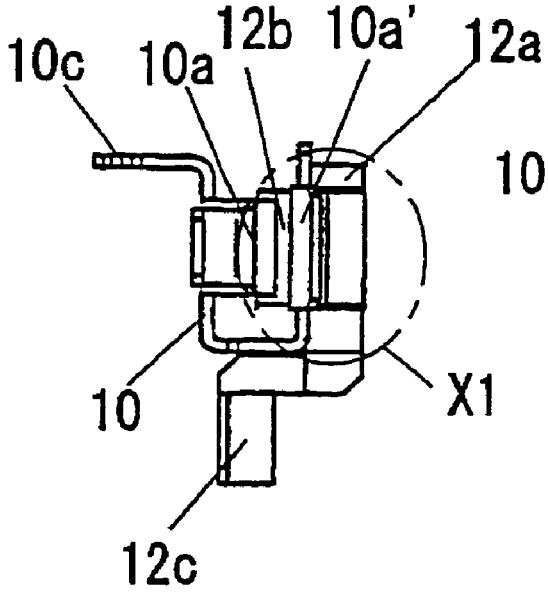
FIG. 32*a* is a plan view of the installed pivot lever portion of the embodiment of FIG. 1.
Figure 32C:
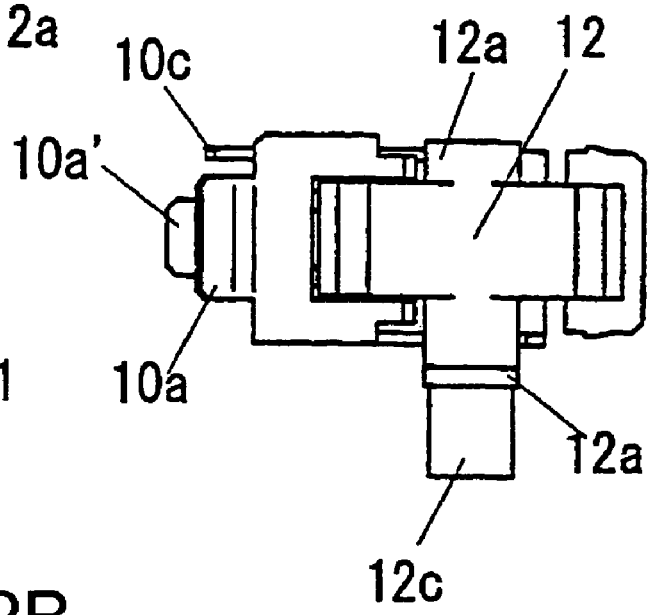
FIG. 32*c* is a side view of the installed pivot lever portion of the embodiment of FIG. 1.
Figure 32B:
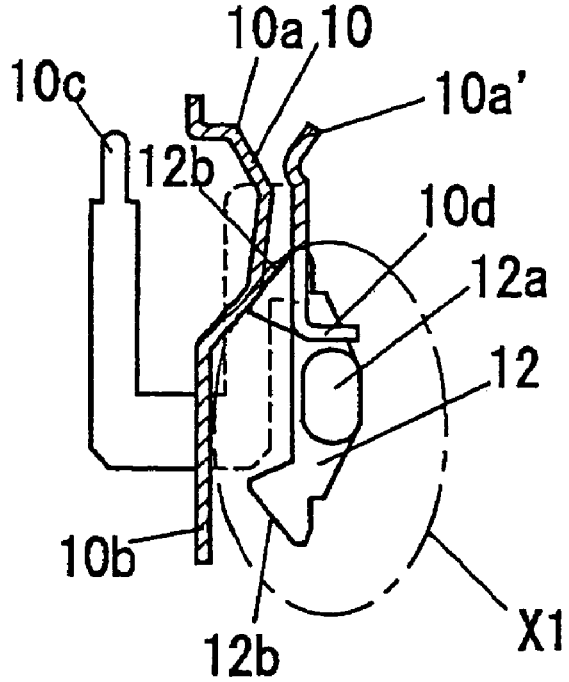
FIG. 32*b* is a front view of the installed pivot lever portion of the embodiment of FIG. 1.

The structural elements of automotive electrical outlet box 'A' described in the present invention are explained below in detail. First, as shown in FIGS. 32*a*, 32*b*, and 32*c*, this embodiment describes pivot lever 12 as being disposed to the rear of blade spring 10*a*' in the space between the two mutually facing blade receivers 10 at area X1 in the middle of body 2. Conventional designs place blade receiver 10 in area X1, but the placement of pivot levers 12 in area X1, as described in this embodiment, allows electrical outlet box 'A' to be made to smaller external dimensions.

Figure 33:
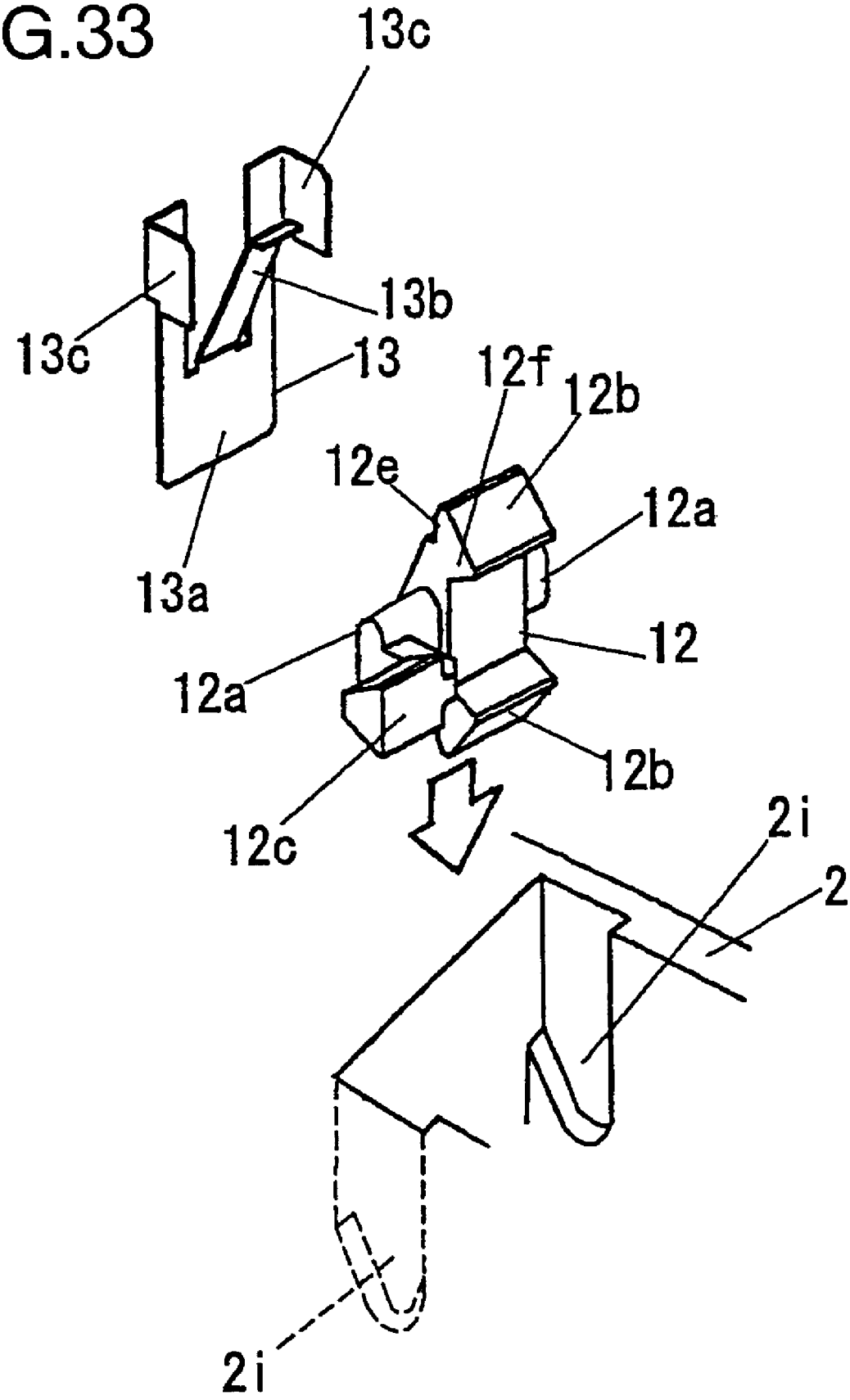
FIG. 33 is a perspective view of the sliding movement of the pivot lever and return spring of the embodiment of FIG. 1.

As shown in FIG. 33, pivot lever 12 is supported within pivot recesses 2*i* which are formed within the inner walls of body 2. The lower part of pivot shaft 12*a* resides within the lower part of each narrowing pivot recess 2*i*, the upper part of each recess 2*i* being open. The provision of pivot recesses 2*i* results in the formation of edge parts on the inner walls of body 2, and thus poses the possibility of slide faces 12*f*, which are located on the radial sides of pivot lever 12, hanging up on the edge parts while slide faces 12*f* slide against the internal wall. To prevent this, return spring 13, which presses against pivot lever 12, includes approximately L-shaped side flanges 13*c* which extend from each side of the front portion of base part 13*a*. Side flanges 13*c* cover the exposed surfaces of pivot recesses 2*i* and thus provide a smooth surface 12*f* against which slide faces 12*f* may slide.

Figure 34:
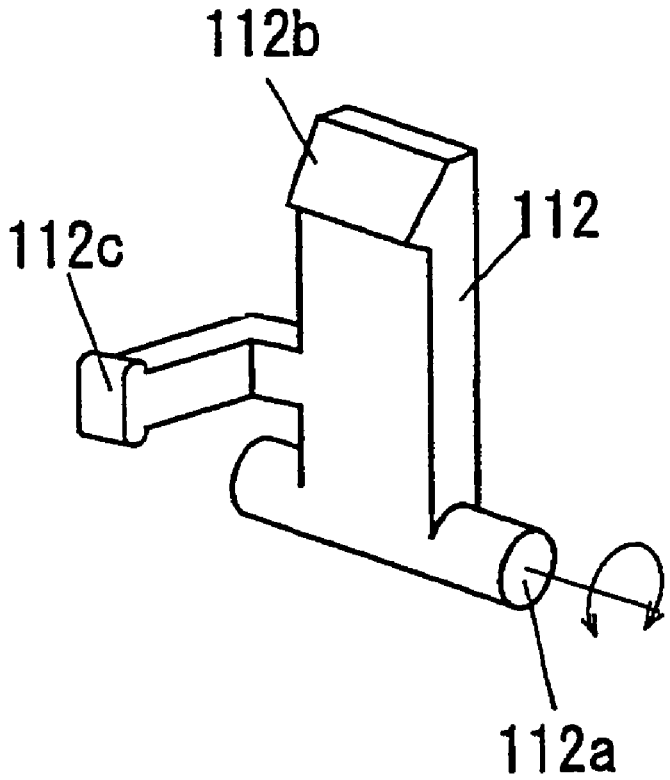
FIG. 34 is a perspective view of a second configuration of a pivot lever portion.

FIG. 34 illustrates a second configured construction of a pivot lever 112 which incorporates approximately round (in cross section) pivot shaft 112*a*. Inclined blade sensor surface 112*b*, which is formed on the end of a board like or planar member extending in the radial direction from the approximate axial center of shaft 112*a*, contacts plug blades 100 and 101 in order to transfer their movement to rotatably move pivot lever 112. Switch operating part 112*c*, which may be formed as an L-shaped member extending from the planar member, transfers the pivoting movement of pivot lever 12 to sensor switch 14*b*. The structure of pivot lever 112 precludes its common use for both plug blade 100 and 101 due to the placement of round pivot shaft 112*a* and the positional relationship between switch operating part 112*c* and pivot shaft 112*a*.

Figure 35:
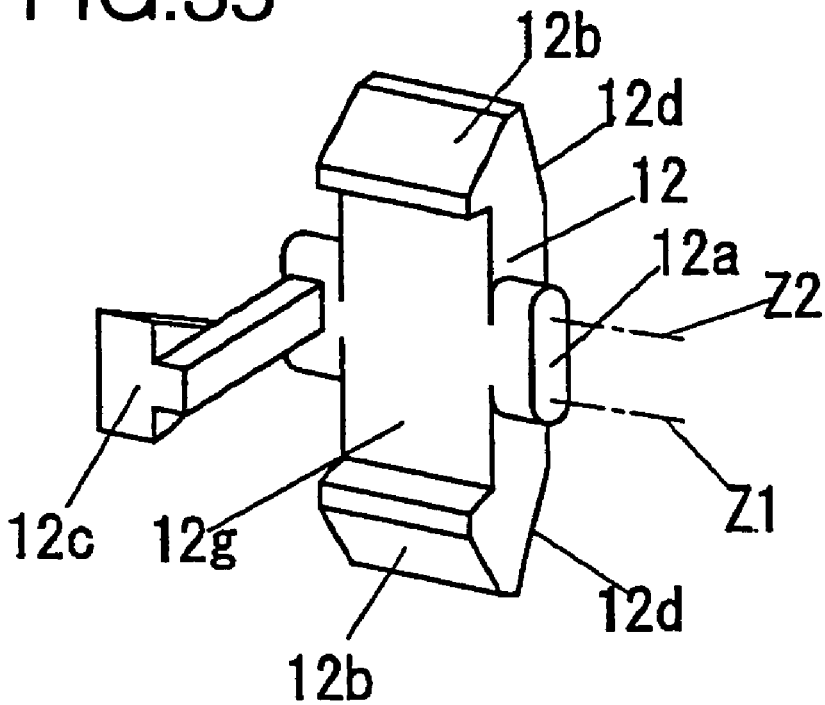
FIG. 35 is a perspective view of the pivot lever portion of the embodiment of FIG. 1.

As previously noted, this embodiment specifies pivot lever 12 as being symmetrically formed in the fore and aft directions with respect to pivot shaft 12*a* which is an approximately barrel-shaped shaft. As shown in FIG. 35, one side of pivot shaft 12*a* is formed as partial shaft Z1 for use with plug blade 100, and the other end is formed as partial shaft Z2 for use with plug blade 101, thus forming a pivot lever configuration that may be commonly used for both plug blades 100 and 101. Moreover, cutout portion 12*g* is provided in the middle of the external side of pivot lever 12 in order to prevent contact with plug blades 100 and 101 when pivot lever 12 pivots. Also, as shown in FIG. 35, cutout portions 12*d* are provided on the internal side of each end of pivot lever 12 in order to prevent interference with body 2 when pivot lever 12 pivots.

Figure 36:
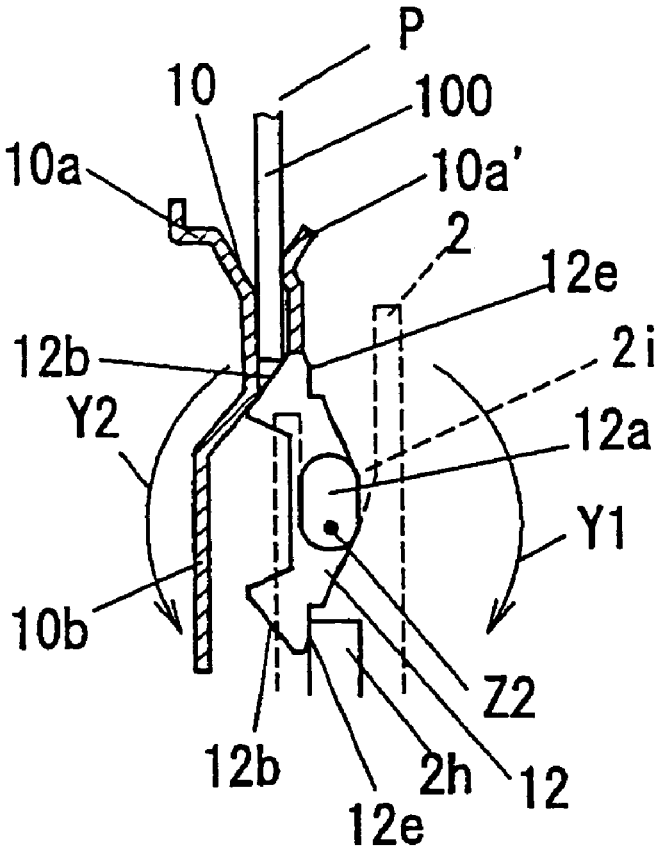
FIG. 36 is a cross sectional view of the stop notch portion that limits the pivoting movement of the pivot lever of the embodiment of FIG. 1.

With respect to the FIG. 35 pivot lever 12 into which cutout portions 12*d* are formed, stop notch 12*e* (which can be seen in FIGS. 25*a*, 25*b*, 25*c*, and 36) is formed as a cutout part, L-shaped in cross section, on each end of pivot lever 12. When plug blades 100 and 101 are not inserted to blade insertion slots 5, pressure applied by return spring 13 holds the cutout surface of stop notch 12*e* against tab 2*h* which extends from the floor of body 2. Inserting the plug blades into blade receivers 10 (this operation is described with reference to FIG. 36 that shows plug blade 100 only) places the plug blade in contact with sensor surface 12*b* of pivot lever 12. The continued insertion of the plug blade is intended to rotate pivot lever 12 in the Y1 (clockwise) direction. However, there is a tendency for the plug blade to push pivot lever 12 in the Y2 (counter-clockwise) direction as a result of plug blade 100 contacting pivot lever 12 to the left of partial shaft Z1 of pivot shaft 12*a* and the relatively large amount of friction with which the plug blade slides against sensor surface 12*b*. This tendency is prevented by the surface of stop notch 12*e* contacting the lateral surface of tab 2*h*.

Figure 37:
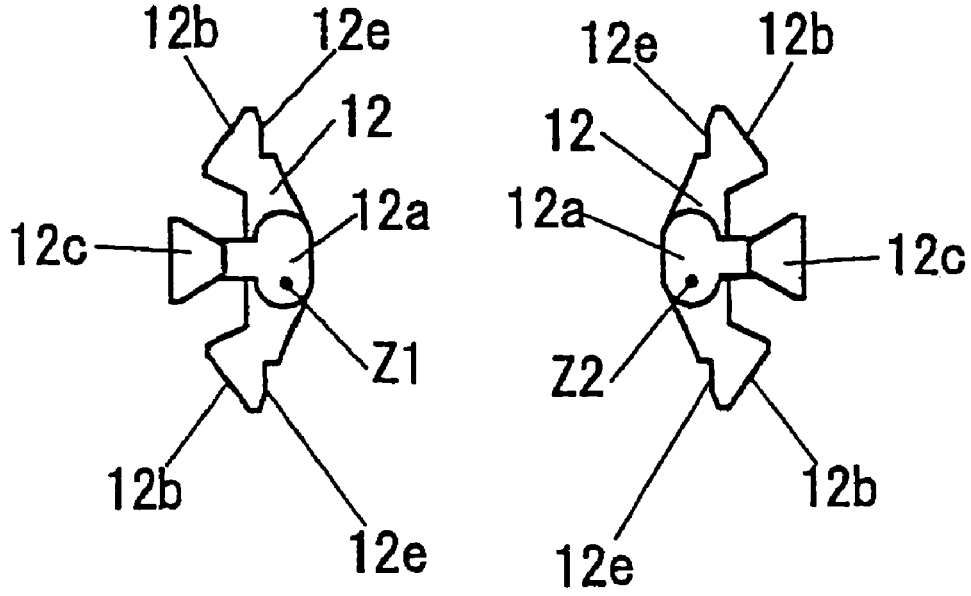
FIG. 37 illustrates how the pivot lever can be turned around for common use.

As shown in FIG. 37, stop notches 12*e* are also symmetrically formed with respect to pivot shaft 12*a*, thus allowing pivot shaft 12 to be flipped over for common use at either plug blade 100 or 101.

Figure 38:
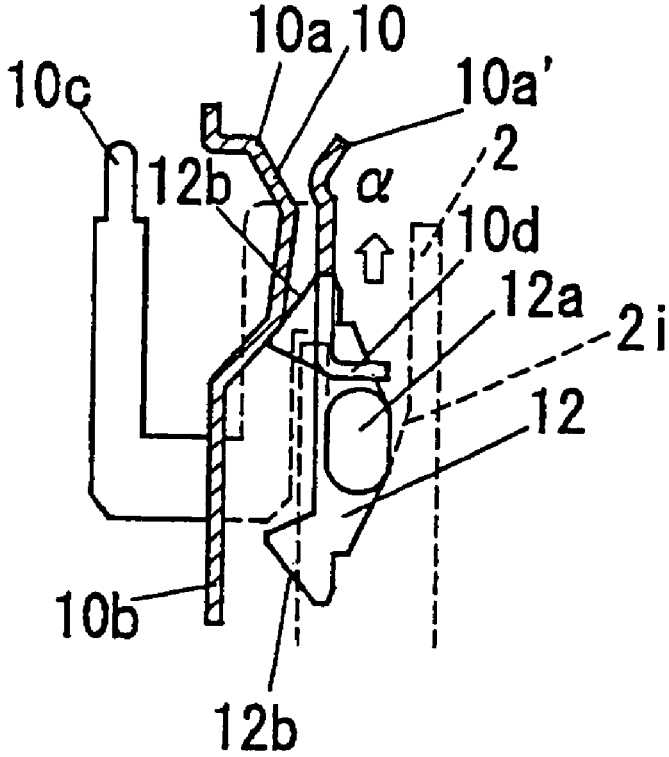
FIG. 38 is a cross sectional view of the stop flange portion of the pivot lever portion of the embodiment of FIG. 21.

Moreover, blade receiver 10, as shown in FIG. 38, includes stop flange 10*d* which is an L-shaped structure bent outward at the rear end of blade spring 10*a*' toward pivot lever 12 and located over the upper side of pivot shaft 12*a* to prevent vibration, shocks applied in the fore and aft direction, and the reactive force generated by the operation of lever 14*c* of microswitch 14*b* from dislodging pivot shaft 12*a* from pivot recess 2*i*, and to prevent malfunctions which may result in the inability to insert or detect the insertion of plug 'P' blades 100 and 101.

Figure 39:
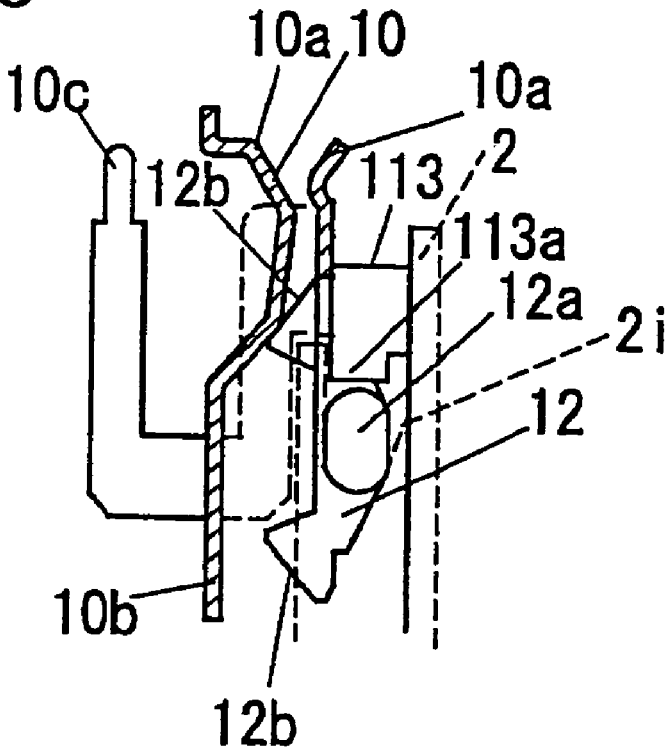
FIG. 39 is a cross sectional view of a second configuration of a stop flange portion of the pivot lever part of the embodiment of FIG. 21.
Figure 40:
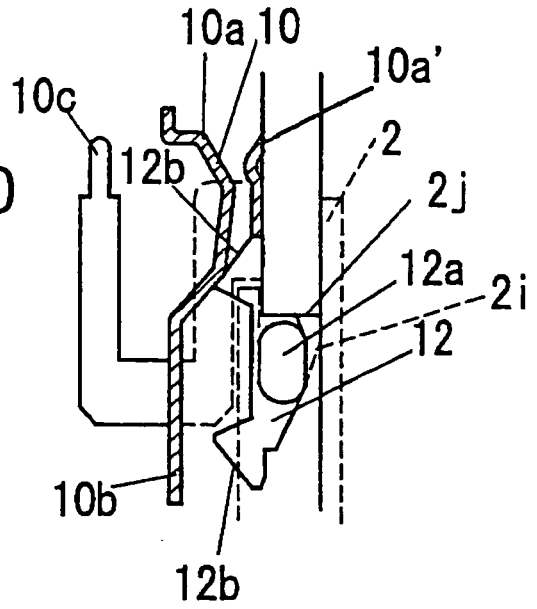
FIG. 40 is a cross sectional view of a third configuration of a stop flange portion of the pivot lever part of the embodiment of FIG. 21.

Although stop flange 10*d* is formed as an integral part of blade spring 10*a*', a rearward extending part of return spring 113 (spring 113 being provided between the front of pivot lever 12 and body 2) may be located over the top of pivot shaft 12*a* as shown in FIG. 39. Furthermore, as shown in FIG. 40, stop flange 2*j*, which is a part of body 2, may also be located over the top of pivot shaft 12*a* in pivot recess 2*i*.

FIG. 41 illustrates printed circuit block 14 which is installed within body 2. The joining of tabs 2*s*, which project from divider wall b in body 2, to notches 14*g*, which are formed in the perimeter of orifices 14*e* in circuit base plate 14*a*, provides a convenient method of indexing printed circuit block 14 to body 2.

Figure 42:
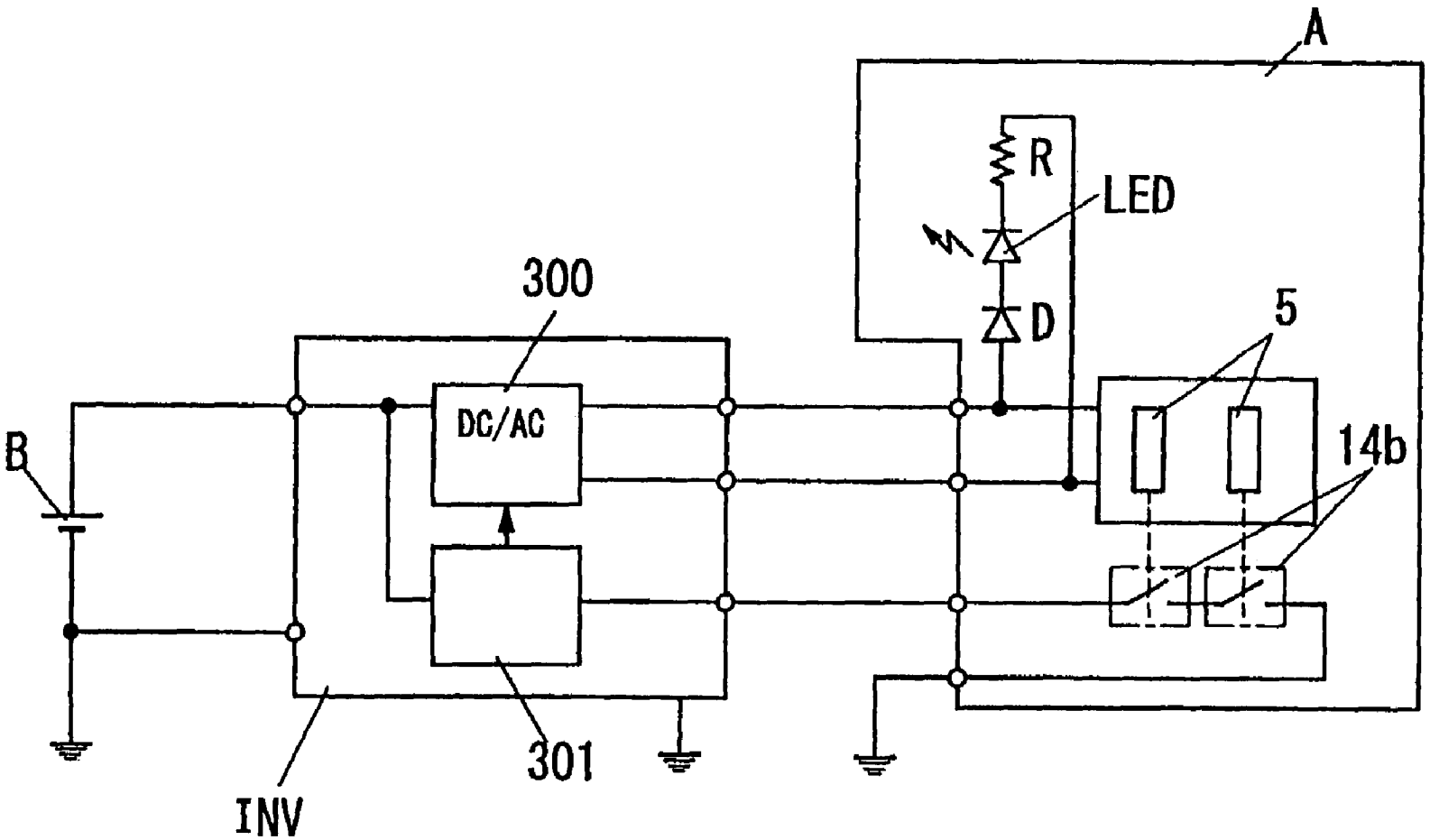
FIG. 42 is a schematic drawing of the printed circuit block circuit structure of the embodiment of FIG. 21.
Figure 43:
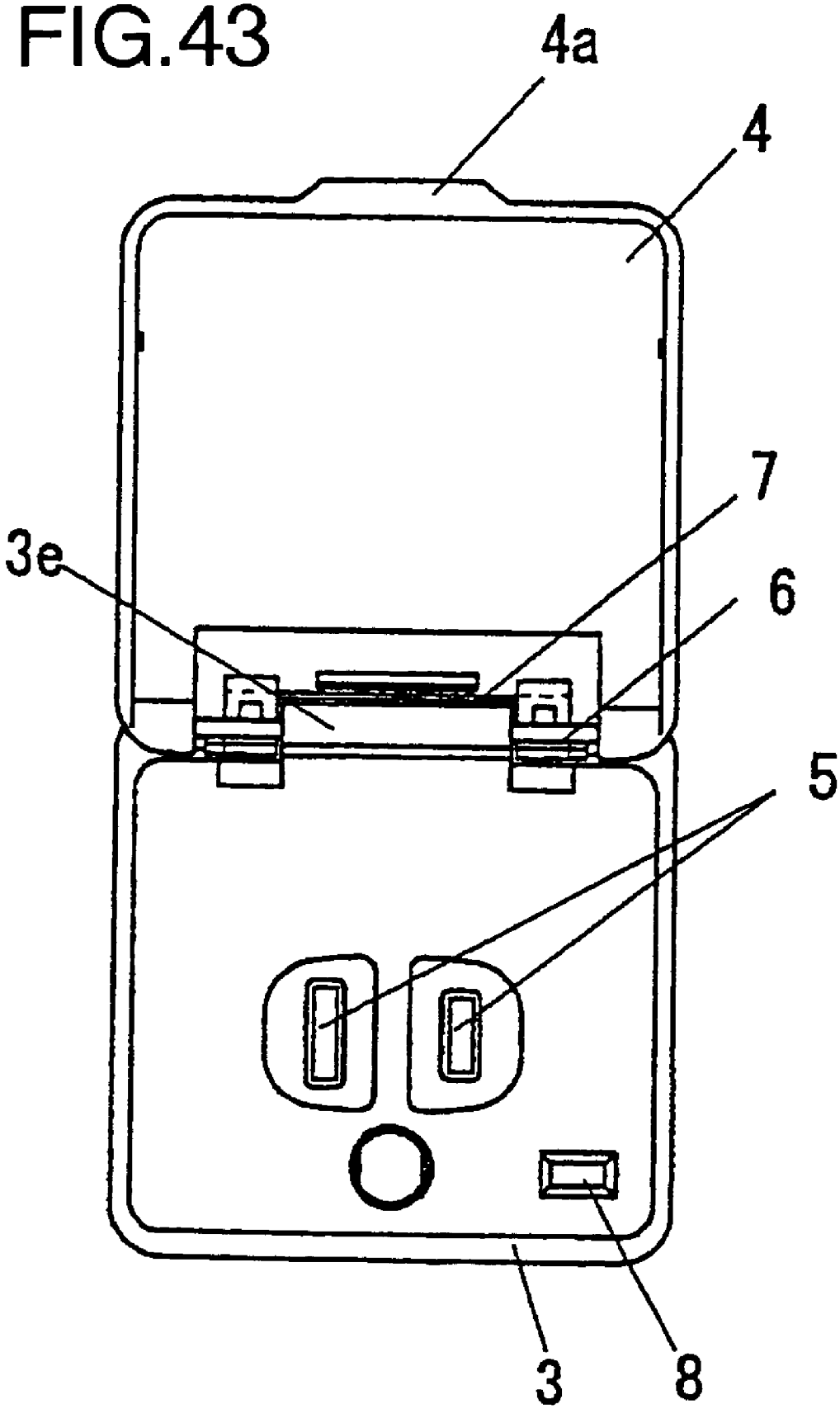
FIG. 43 is a plan view of the embodiment of FIG. 21, with the outer cover in the open position.
Figure 44A:
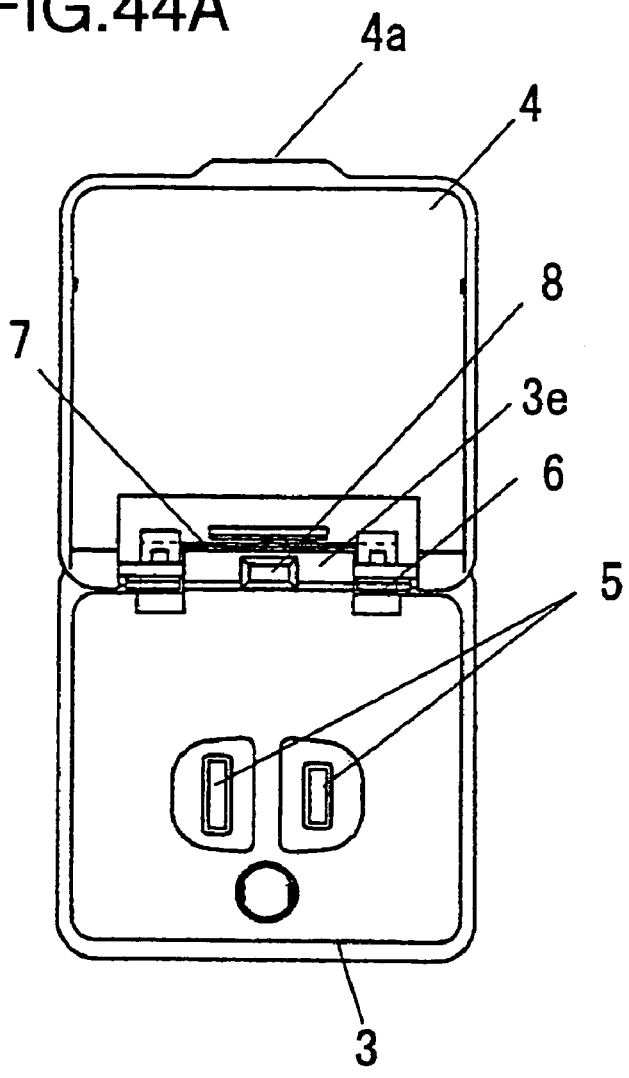
FIG. 44*a* is a plan view of another embodiment of FIG. 21, with the outer cover in the open position.
Figure 44B:
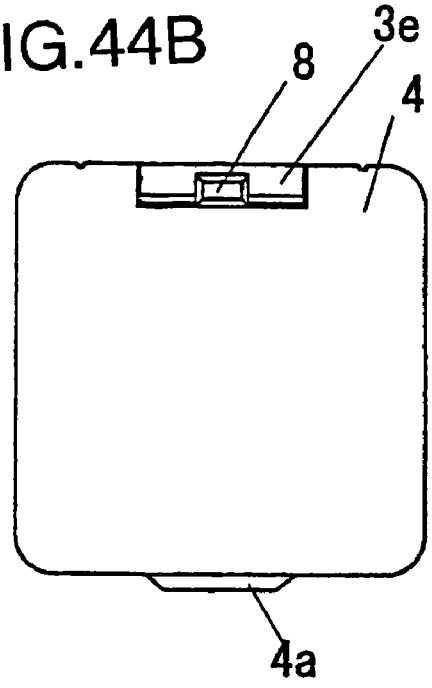
FIG. 44*b* is a plan view of the embodiment of FIG. 44*a*, with the outer cover in the closed position.

Furthermore, a current flow indicator LED and diode 'D' are provided on the front of circuit base plate 14*a*, and resistor 'R' is provided on the rear (see FIGS. 29 through 31). These three components are wired in series, with resistor 'R', between blade receivers 10 (see FIG. 42), thus resulting in the LED illuminating when 100V of alternating current is being supplied by inverter circuit INV. Transparent synthetic resin LED cover 8 (see FIGS. 1 and 3), is provided in window 3*b* which is formed within cover 3 opposite the LED, thus making it possible to verify the illumination of the LED. Although FIG. 3 shows LED cover 8 installed on the hinge support 3*e* side of cover 3, LED cover 8 may, as shown in FIG. 43, be installed on the side of cover 3 opposite to hinge support 3*e*. Also, as shown in FIG. 44, the installation of LED cover 8 to hinge support 3*e* allows the illumination of the LED to be verified with external cover 4 closed. Furthermore, external cover 4 may consist of a transparent or translucent material which allows the illumination of the LED to be verified even with external cover 4 closed.

Although the invention has been described with reference to an exemplary embodiment, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed. Rather, the invention extends to all functionally equivalent structures, methods, and uses such as are within the scope of the appended claims.

The present disclosure relates to subject matter contained in priority Japanese Application No. 2003-290717, filed on Aug. 8, 2003, which is herein expressly incorporated by reference in its entirety.

What is claimed is:

1. A vehicle mounted electrical outlet box comprising:

a case including a pair of plug blade insertion slots configured to receive a pair of plug blades inserted therein;

a pair of blade receiver portions electrically connected to an electrical power source of the vehicle, said blade receiver portions configured to press against plug blades inserted into said case through said plug blade insertion slots;

a pair of plug blade detection mechanisms configured to detect the presence of each plug blade inserted into each said plug blade insertion slot;

a pair of sensor switches, each said sensor switch including 'on' and 'off' switching contact points that operate in response to detection of the presence of a plug blade by said detection mechanism, wherein said detection mechanisms are located between opposing blade receiver portions, and said contact points of each sensor switch are electrically wired together in a series configuration; and wherein each said plug blade insertion detection mechanism comprises:

a pivot lever configured to pivot from the force with which the plug blades are inserted into said plug blade insertion slots, each pivot lever including a pivot shaft pivotably supported by said case, an inclined blade sensor surface that changes the plug blade insertion force to a directional force that intersects the plug blade insertion direction, and a switch operating part driven by the directional force in order to operate a sensor switch, which is mounted to a base plate, when said pivot lever pivots from the directional force, wherein said case and base plate are joined through a connection of mutually indexed recessed notches and projecting tabs are provided on said case and base plate.

2. A vehicle mounted electrical outlet box comprising:

a case including a pair of plug blade insertion slots configured to receive a pair of plug blades inserted therein;

a pair of blade receiver portions electrically connected to an electrical power source of the vehicle, said blade receiver portions configured to press against plug blades inserted into said case through said plug blade insertion slots;

a pair of plug blade detection mechanisms configured to detect the presence of each plug blade inserted into each said plug blade insertion slot;

a pair of sensor switches, each said sensor switch including 'on' and 'off' switching contact points that operate in response to detection of the presence of a plug blade by said detection mechanism, wherein said detection mechanisms are located between opposing blade receiver portions, and said contact points of each sensor switch are electrically wired together in a series configuration; and wherein each said plug blade insertion detection mechanism comprises:

a pivot lever configured to pivot from the insertion of the plug blades into said plug blade insertion slots, each said pivot lever including a pivot shaft pivotably supported by said case, an inclined blade sensor surface through which plug blade insertion force is converted to a directional force that intersects the plug blade insertion direction, and a switch operating part driven by the directional force in order to operate said sensor switches when said pivot lever pivots, wherein the axial ends of said pivot shaft have an approximately oval shape.

3. A vehicle mounted electrical outlet box comprising:

a case including a pair of plug blade insertion slots configured to receive a pair of plug blades inserted therein;

a pair of blade receiver portions electrically connected to an electrical power source of the vehicle, said blade receiver portions configured to press against plug blades inserted into said case through said plug blade insertion slots;

a pair of plug blade detection mechanisms configured to detect the presence of each plug blade inserted into each said plug blade insertion slot;

a pair of sensor switches, each said sensor switch including 'on' and 'off' switching contact points that operate in response to detection of the presence of a plug blade by said detection mechanism, wherein said detection mechanisms are located between opposing blade receiver portions, and said contact points of each sensor switch are electrically wired together in a series configuration; and wherein each said plug blade insertion detection mechanism comprises:

a pivot lever configured to pivot from the force with which the plug blades are inserted into said plug blade insertion slots, each pivot lever including a pivot shaft pivotably supported by said case, an inclined blade sensor surface through which the plug blade insertion force is converted to a directional force that intersects the plug blade insertion direction, and a switch operating part driven by the directional force in order to operate said sensor switches when said pivot lever pivots, wherein said blade receiver part includes a stop flange that presses against the pivot shaft of the pivot lever in order to maintain the pivot lever in a fixed position.

4. A vehicle mounted electrical outlet box comprising:

a case including a pair of plug blade insertion slots configured to receive a pair of plug blades inserted therein;

a pair of blade receiver portions electrically connected to an electrical power source of the vehicle, said blade receiver portions configured to press against plug blades inserted into said case through said plug blade insertion slot;

a pair of plug blade detection mechanisms configured to detect the presence of each plug blade inserted into each said plug blade insertion slot;

a pair of sensor switches, each said sensor switch including 'on' and 'off' switching contact points that operate in response to detection of the presence of a plug blade by said detection mechanism, wherein said detection mechanisms are located between opposing blade receiver portions, and said contact points of each sensor switch are electrically wired together in a series configuration; and wherein each said plug blade insertion detection mechanism comprises:

a pivot lever configured to pivot from the force with which the plug blades are inserted into said plug blade insertion slots, each pivot lever including a pivot shaft pivotably supported by aid case, an inclined blade sensor surface through which the plug blade insertion force is converted to a directional force that intersects the plug blade insertion direction, and a switch operating part driven by the directional force in order to operate said sensor switches when said pivot lever pivots, wherein a return spring applies pressure against said pivot lever in a direction opposite to that in which said pivot lever is pivotably moved by the plug blade insertion force.

5. A vehicle mounted electrical outlet box comprising:

a case including a pair of plug blade insertion slots configured to receive a pair of plug blades inserted therein;

a pair of blade receiver portions electrically connected to an electrical power source of the vehicle, said blade receiver portions configured to press against plug blades inserted into said case through said plug blade insertion slots;

a pair of plug blade detection mechanisms configured to detect the presence of each plug blade inserted into each said plug blade insertion slot;

a pair of sensor switches, each said sensor switch including 'on' and 'off' switching contact points that operate in response to detection of the presence of a plug blade by said detection mechanism, wherein said detection mechanisms are located between opposing blade receiver portions, and said contact points of each sensor switch are electrically wired together in a series configuration; and wherein each said plug blade insertion detection mechanism comprises:

a pivot lever configured to pivot from the force with which the plug blades are inserted into the plug blade insertion slots, each pivot lever including a pivot shaft pivotably supported by said case, and an inclined blade sensor surface that changes the plug blade insertion force to a directional force that intersects the plug blade insertion direction, and a switch operating part which is driven by the directional force in order to operate said sensor switches when said pivot lever pivots, wherein a pivot recess is provided within an internal wall in said case in order to pivotably support said pivot shaft, and a metal plate is provided to cover and conceal said pivot recess in order to provide a surface on which the surface of said pivot lever, on which the pivot shaft is provided, may slide.

6. A vehicle mounted electrical outlet box comprising:

a case including a pair of plug blade insertion slots configured to receive a pair of plug blades inserted therein;

a pair of blade receiver portions electrically connected to an electrical power source of the vehicle, said blade receiver portions configured to press against plug blades inserted into said case through said plug blade insertion slots;

a pair of plug blade detection mechanisms configured to detect the presence of each plug blade inserted into each said plug blade insertion slot;

a pair of sensor switches, each said sensor switch including 'on' and 'off' switching contact points that operate in response to detection of the presence of a plug blade by said detection mechanism, wherein said detection mechanisms are located between opposing blade receiver portions, and said contact points of each sensor switch are electrically wired together in a series configuration; and wherein each said plug blade insertion detection mechanism comprises:

a pivot lever configured to pivot from the force with which the plug blades are inserted into said plug blade insertion slots, each pivot lever including a pivot shaft pivotably supported by said case, an inclined blade sensor surface that changes the plug blade insertion force to a directional force that intersects the plug blade insertion direction, and a switch operating part which is driven by the directional force in order to operate said sensor switches when said pivot lever pivots, wherein a stop notch is provided on said pivot lever contacts a surface within the case at a time when the plug blades are not present in the blade insertion slots, said contact occurring in a pivoting direction opposite to that induced by the directional force.

7. The vehicle mounted electrical outlet box according to claim 6, wherein said stop notch is provided on both ends of said pivot lever on the radial axis thereof.

* * * * *

UNITED STATES PATENT AND TRADEMARK OFFICE

CERTIFICATE OF CORRECTION

PATENT NO. : 7,090,520 B2
APPLICATION NO. : 10/912037
DATED : August 15, 2006
INVENTOR(S) : Matsukawa et al.

It is certified that error appears in the above-identified patent and that said Letters Patent is hereby corrected as shown below:

At column 14, line 12 (claim 4, line 26) of the printed patent, "aid case" should be --said case--.

Signed and Sealed this

Twenty-fourth Day of July, 2007

JON W. DUDAS
*Director of the United States Patent and Trademark Office*